US012281850B2

(12) United States Patent
Daggett et al.

(10) Patent No.: US 12,281,850 B2
(45) Date of Patent: Apr. 22, 2025

(54) MULTI-FLUID HEAT EXCHANGER

(71) Applicant: General Electric Company, Schenectady, NY (US)

(72) Inventors: Nicholas M. Daggett, Cincinnati, OH (US); Steven Douglas Johnson, Milford, OH (US); Anand P. Roday, Mason, OH (US); Scott Alan Schimmels, Miamisburg, OH (US)

(73) Assignee: General Electric Company, Evendale, OH (US)

( * ) Notice: Subject to any disclaimer, the term of this patent is extended or adjusted under 35 U.S.C. 154(b) by 0 days.

(21) Appl. No.: 18/613,306

(22) Filed: Mar. 22, 2024

(65) Prior Publication Data

US 2024/0263883 A1 Aug. 8, 2024

Related U.S. Application Data

(62) Division of application No. 17/190,103, filed on Mar. 2, 2021, now Pat. No. 11,965,697.

(51) Int. Cl.

| | |
|---|---|
| ***F28D 1/04*** | (2006.01) |
| ***F28D 1/02*** | (2006.01) |
| ***F28D 1/047*** | (2006.01) |
| ***F28F 9/00*** | (2006.01) |

(52) U.S. Cl.

CPC ..... *F28D 1/0443* (2013.01); *F28D 1/0233* (2013.01); *F28D 1/0475* (2013.01); *F28F 9/001* (2013.01); *F28D 2001/0273* (2013.01)

(58) Field of Classification Search

CPC .... F28D 1/0443; F28D 1/0233; F28D 1/0475; F28D 2001/0273; F28F 9/001

USPC ..... 165/173

See application file for complete search history.

(56) References Cited

U.S. PATENT DOCUMENTS

| | | | | |
|---|---|---|---|---|
| 2,474,258 | A * | 6/1949 | Kroon | F02C 7/047 244/134 B |
| 3,064,947 | A | 11/1962 | McNab | |
| 3,735,588 | A | 5/1973 | Moskowitz et al. | |
| 3,981,466 | A | 9/1976 | Shah | |

(Continued)

FOREIGN PATENT DOCUMENTS

| | | | |
|---|---|---|---|
| CN | 104018952 | A * | 9/2014 |
| CN | 206131513 | U | 4/2017 |

(Continued)

*Primary Examiner* — Jon T. Schermerhorn, Jr.

(74) *Attorney, Agent, or Firm* — Dority & Manning, P.A.

(57) ABSTRACT

A heat exchanger is provided. The heat exchanger includes a first wall manifold. The heat exchanger further includes a second wall manifold spaced apart from the first wall manifold. The heat exchanger further includes a plurality of vanes that extend generally circumferentially between the first wall manifold and the second wall manifold. The heat exchanger further includes a plurality of fluid circuits defined within the heat exchanger. Each fluid circuit in the plurality of fluid circuits includes an inlet channel portion and an outlet channel portion defined within the first wall manifold. A return channel portion defined within the second wall manifold. At least one passage portion of a plurality of passage portions defined within each vane of the plurality of vanes. The at least one passage portion extends between the return channel portion and one of the inlet channel portion and the outlet channel portion.

20 Claims, 11 Drawing Sheets

(56) References Cited

U.S. PATENT DOCUMENTS

| | | | | |
|---|---|---|---|---|
| 4,187,675 | A | 2/1980 | Wakeman | |
| 5,318,110 | A * | 6/1994 | Wei | F28D 7/08 165/145 |
| 5,386,689 | A | 2/1995 | Bozich et al. | |
| 6,302,197 | B1 | 10/2001 | Hornby et al. | |
| 6,866,033 | B2 * | 3/2005 | Stacy | A21B 1/48 99/443 C |
| 7,377,098 | B2 * | 5/2008 | Walker | F01D 25/18 60/39.83 |
| 7,607,308 | B2 | 10/2009 | Kraft et al. | |
| 8,702,378 | B2 | 4/2014 | Foster | |
| 8,844,264 | B2 | 9/2014 | Khalid | |
| 8,961,114 | B2 | 2/2015 | Ruthemeyer | |
| 9,249,730 | B2 * | 2/2016 | Bourassa | F01D 5/189 |
| 9,410,482 | B2 * | 8/2016 | Krautheim | F02K 3/06 |
| 9,422,063 | B2 * | 8/2016 | Diaz | F02C 3/04 |
| 9,593,594 | B2 * | 3/2017 | Diaz | F02C 7/00 |
| 9,677,501 | B2 | 6/2017 | Pierluissi et al. | |
| 9,702,630 | B2 * | 7/2017 | Whaites | F28D 7/0008 |
| 9,771,867 | B2 * | 9/2017 | Karam | F28D 7/0058 |
| 9,777,963 | B2 * | 10/2017 | Martinez | F28D 7/082 |
| 9,790,893 | B2 * | 10/2017 | Snyder | F02C 7/14 |
| 9,835,380 | B2 * | 12/2017 | Kupiszewski | F01D 25/12 |
| 9,845,768 | B2 | 12/2017 | Pesyna et al. | |
| 10,006,369 | B2 * | 6/2018 | Kupiszewski | F28D 7/10 |
| 10,030,912 | B2 * | 7/2018 | Yanik | F28B 1/06 |
| 10,036,329 | B2 | 7/2018 | Suciu | |
| 10,227,950 | B1 | 3/2019 | Dyson, Jr. | |
| 10,364,750 | B2 | 7/2019 | Rambo | |
| 10,429,134 | B2 * | 10/2019 | Yanik | F28D 1/047 |
| 10,507,934 | B1 | 12/2019 | Dyson, Jr. | |
| 10,544,737 | B2 | 1/2020 | Bowden et al. | |
| 10,550,767 | B2 * | 2/2020 | Eleftheriou | F02C 7/08 |
| 10,654,579 | B2 * | 5/2020 | Diaz | F02C 7/141 |
| 10,677,166 | B2 | 6/2020 | Pesyna et al. | |
| 10,782,071 | B2 | 9/2020 | Cerny et al. | |
| 11,002,491 | B2 * | 5/2021 | Pollard | F28D 9/0093 |
| 11,378,009 | B2 * | 7/2022 | Roberge | F02K 3/115 |
| 11,619,169 | B2 | 4/2023 | Weicker et al. | |
| 11,650,018 | B2 * | 5/2023 | Roberge | F28D 7/08 165/153 |
| 2015/0023776 | A1 * | 1/2015 | Ribarov | F01D 9/065 415/1 |
| 2016/0017810 | A1 | 1/2016 | Lord et al. | |
| 2016/0312702 | A1 * | 10/2016 | Thomas | F28F 27/02 |
| 2018/0328285 | A1 | 11/2018 | Tajiri et al. | |
| 2019/0024988 | A1 | 1/2019 | Wilson et al. | |
| 2020/0122843 | A1 | 4/2020 | Porte et al. | |

FOREIGN PATENT DOCUMENTS

| | | | | | |
|---|---|---|---|---|---|
| CN | 105473973 | B | * | 7/2017 | B23P 15/26 |
| CN | 105277023 | B | * | 2/2019 | B23P 15/26 |
| CN | 110081461 | A | * | 8/2019 | B23P 15/26 |
| CN | 111594286 | A | * | 8/2020 | |
| EP | 3130539 | A1 | | 2/2017 | |
| EP | 3508806 | B1 | * | 10/2020 | B23K 1/0012 |
| EP | 3735518 | A1 | | 11/2020 | |
| FR | 2860289 | A1 | * | 4/2005 | F28D 1/05366 |
| GB | 2525971 | A | * | 11/2015 | B64D 13/00 |
| JP | 2016109124 | A | * | 6/2016 | F04D 29/321 |
| JP | 6216360 | B2 | * | 10/2017 | B64D 33/12 |
| WO | WO-2005031240 | A1 | * | 4/2005 | F28D 1/05366 |

* cited by examiner

MULTI-FLUID HEAT EXCHANGER

CROSS-REFERENCE TO RELATED APPLICATIONS

This application is a Divisional Application of U.S. application Ser. No. 17/190,103 filed Mar. 2, 2021, which is hereby incorporated by reference in its entirety.

FIELD

The present subject matter relates generally to heat exchangers capable of cooling and/or heating multiple motive fluids at a time. In particular, the present subject matter relates to utilizing said heat exchangers within an air flowpath of a propulsion system.

BACKGROUND

A gas turbine engine typically includes a fan and a turbomachine. The turbomachine generally includes an inlet, one or more compressors, a combustor, and at least one turbine. The compressors compress air which is channeled to the combustor where it is mixed with fuel. The mixture is then ignited for generating hot combustion gases. The combustion gases are channeled to the turbine(s) which extracts energy from the combustion gases for powering the compressor(s), as well as for producing useful work to propel an aircraft in flight or to power a load, such as an electrical generator.

In at least certain embodiments, the gas turbine may employ an open rotor propulsion system that operates on the principle of having a fan located outside of the engine nacelle, in other words, "unducted". This permits the use of larger fan blades able to act upon a larger volume of air than for a turbofan engine, and thereby improves propulsive efficiency over conventional ducted engine designs.

During operation of the gas turbine engine, such as a gas turbine employing an open rotor propulsion system, various systems may generate a relatively large amount of heat. For example, a substantial amount of heat may be generated during operation of the thrust generating systems, electric motors and/or generators, hydraulic systems or other systems. Accordingly, a means for dissipating the heat generated by the various systems without negatively impacting the efficiency of the gas turbine engine would be advantageous in the art.

BRIEF DESCRIPTION

Aspects and advantages of the invention will be set forth in part in the following description, or may be obvious from the description, or may be learned through practice of the invention.

In one exemplary aspect of the present disclosure, a heat exchanger for use in an aircraft engine is provided. The heat exchanger includes a first wall manifold. The heat exchanger further includes a second wall manifold spaced apart from the first wall manifold. The heat exchanger further includes a plurality of vanes that extend generally circumferentially between the first wall manifold and the second wall manifold. The heat exchanger further includes a plurality of fluid circuits defined within the heat exchanger. Each fluid circuit in the plurality of fluid circuits includes an inlet channel portion and an outlet channel portion defined within the first wall manifold. A return channel portion defined within the second wall manifold. At least one passage portion of a plurality of passage portions defined within each vane of the plurality of vanes. The at least one passage portion extends between the return channel portion and one of the inlet channel portion and the outlet channel portion.

These and other features, aspects, and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION

Figure 1:
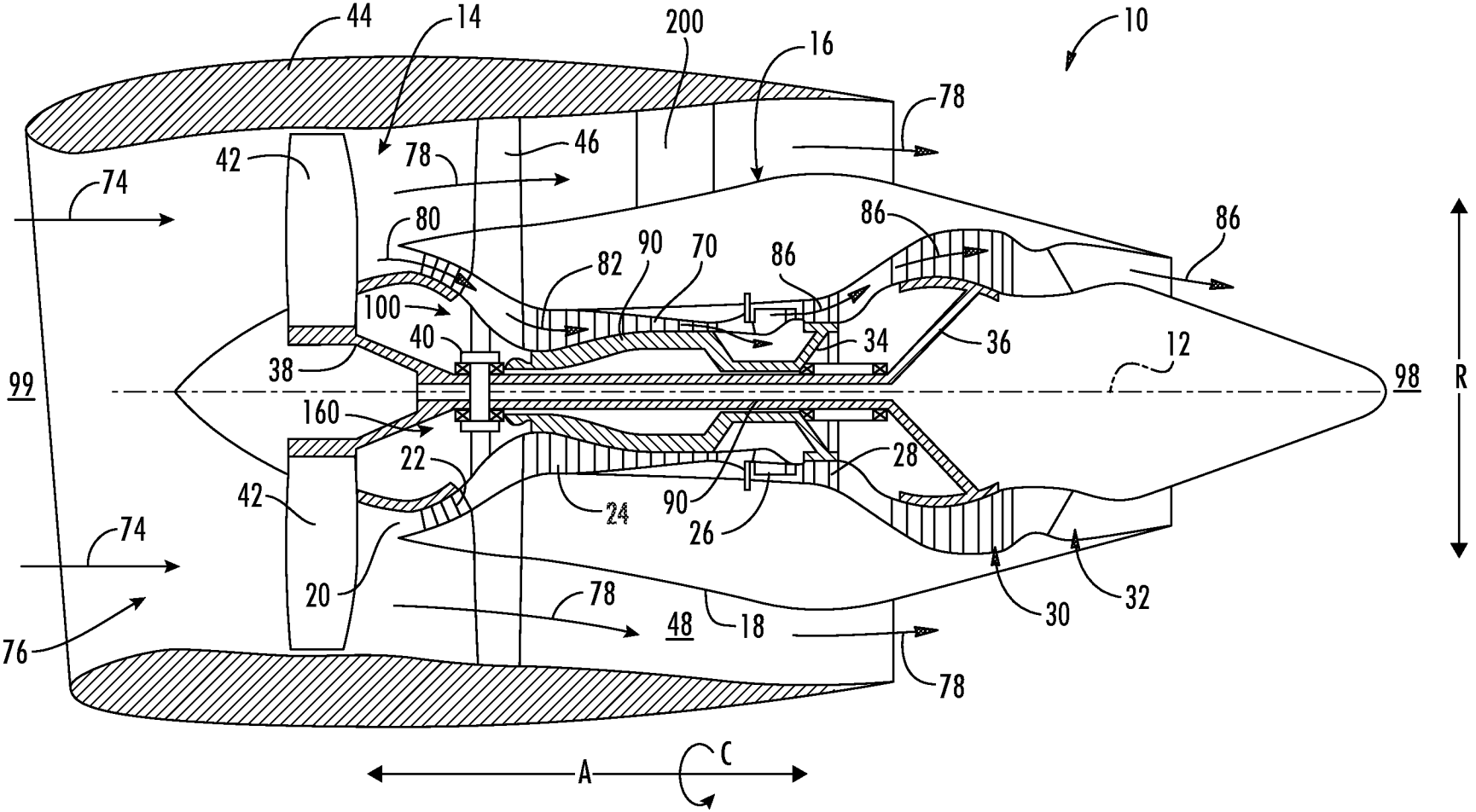
FIG. 1 is a schematic cross-sectional view of a gas turbine engine in accordance with an exemplary embodiment of the present disclosure.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention.

The word "exemplary" is used herein to mean "serving as an example, instance, or illustration." Any implementation described herein as "exemplary" is not necessarily to be construed as preferred or advantageous over other implementations. Additionally, unless specifically identified otherwise, all embodiments described herein should be considered exemplary.

As used herein, the terms "first", "second", and "third" may be used interchangeably to distinguish one component from another and are not intended to signify location or importance of the individual components.

The terms "forward" and "aft" refer to relative positions within a gas turbine engine or vehicle, and refer to the normal operational attitude of the gas turbine engine or vehicle. For example, with regard to a gas turbine engine, forward refers to a position closer to an engine inlet and aft refers to a position closer to an engine nozzle or exhaust.

The terms "upstream" and "downstream" refer to the relative direction with respect to a flow in a pathway. For example, with respect to a fluid flow, "upstream" refers to the direction from which the fluid flows, and "downstream" refers to the direction to which the fluid flows. However, the terms "upstream" and "downstream" as used herein may also refer to a flow of electricity.

The term "fluid" may be a gas or a liquid. The term "fluid communication" means that a fluid is capable of making the connection between the areas specified.

The singular forms "a", "an", and "the" include plural references unless the context clearly dictates otherwise.

Approximating language, as used herein throughout the specification and claims, is applied to modify any quantitative representation that could permissibly vary without resulting in a change in the basic function to which it is related. Accordingly, a value modified by a term or terms, such as "about", "approximately", "generally", and "substantially", are not to be limited to the precise value specified. In at least some instances, the approximating language may correspond to the precision of an instrument for measuring the value, or the precision of the methods or machines for constructing or manufacturing the components and/or systems. In at least some instances, the approximating language may correspond to the precision of an instrument for measuring the value, or the precision of the methods or machines for constructing or manufacturing the components and/or systems. For example, the approximating language may refer to being within a 1, 2, 4, 5, 10, 15, or 20 percent margin in either individual values, range(s) of values and/or endpoints defining range(s) of values. When used in the context of an angle or direction, such terms include within ten degrees greater or less than the stated angle or direction. For example, "generally vertical" includes directions within ten degrees of vertical in any direction, e.g., clockwise or counter-clockwise.

Here and throughout the specification and claims, range limitations are combined and interchanged, such ranges are identified and include all the sub-ranges contained therein unless context or language indicates otherwise. For example, all ranges disclosed herein are inclusive of the endpoints, and the endpoints are independently combinable with each other.

In accordance with one or more embodiments described herein, a three-stream engine can be equipped with one or more heat exchangers. The heat exchangers can be provided to cool certain systems of the gas turbine engine or of the aircraft that the gas turbine engine is installed upon. For example, the heat exchanger(s) may be provided to cool a turbine section or an auxiliary system, such as a lubrication system. The heat transfer system can cool these systems by cooling a fluid, such as air or a lubricant, that is delivered to these systems.

Systems are described herein that extend beyond the three-stream engine. It will be appreciated that these systems are provided by way of example only, and the claimed systems are not limited to applications using or otherwise incorporated with these other systems. The disclosure is not intended to be limiting. For example, it should be understood that one or more embodiments described herein may be configured to operate independently or in combination with other embodiments described herein.

Referring now to the drawings, FIG. 1 is a schematic partially cross-sectioned side view of an exemplary gas turbine engine 10 as may incorporate various embodiments of the present invention. The engine 10 may particularly be configured as a gas turbine engine for an aircraft. Although further described herein as a turbofan engine, the engine 10 may define a turboshaft, turboprop, or turbojet gas turbine engine, including marine and industrial engines and auxiliary power units. As shown in FIG. 1, the engine 10 has a longitudinal or axial centerline axis 12 that extends therethrough for reference purposes. An axial direction A is extended co-directional to the axial centerline axis 12 for reference. The engine 10 further defines an upstream end 99 and a downstream end 98 for reference. In general, the engine 10 may include a fan assembly 14 and a core engine 16 disposed downstream from the fan assembly 14. For reference, the engine 10 defines an axial direction A, a radial direction R, and a circumferential direction C. In general, the axial direction A extends parallel to the axial centerline 12, the radial direction R extends outward from and inward to the axial centerline 12 in a direction orthogonal to the axial direction A, and the circumferential direction extends three hundred sixty degrees (360°) around the axial centerline 12.

The core engine 16 may generally include a substantially tubular outer casing 18 that defines an annular inlet 20. The outer casing 18 encases or at least partially forms, in serial flow relationship, a compressor section having a booster or low pressure (LP) compressor 22, a high pressure (HP) compressor 24, a heat addition system 26, an expansion section or turbine section including a high pressure (HP) turbine 28, a low pressure (LP) turbine 30 and a jet exhaust nozzle section 32. A high pressure (HP) rotor shaft 34 drivingly connects the HP turbine 28 to the HP compressor 24. A low pressure (LP) rotor shaft 36 drivingly connects the LP turbine 30 to the LP compressor 22. The LP rotor shaft 36 may also be connected to a fan shaft 38 of the fan assembly 14. In particular embodiments, as shown in FIG. 1, the LP rotor shaft 36 may be connected to the fan shaft 38 via a reduction gear 40 such as in an indirect-drive or geared-drive configuration.

As shown in FIG. 1, the fan assembly 14 includes a plurality of fan blades 42 that are coupled to and that extend radially outwardly from the fan shaft 38. An annular fan casing or nacelle 44 circumferentially may surround the fan assembly 14 and/or at least a portion of the core engine 16. It should be appreciated by those of ordinary skill in the art that the nacelle 44 may be configured to be supported relative to the core engine 16 by a plurality of circumferentially-spaced outlet guide vanes or struts 46. Moreover, at least a portion of the nacelle 44 may extend over an outer portion of the core engine 16 so as to define a fan flow passage 48 therebetween. However, it should be appreciated that various configurations of the engine 10 may omit the nacelle 44, or omit the nacelle 44 from extending around the fan blades 42, such as to provide an open rotor or propfan configuration of the engine 10 depicted in FIG. 2.

It should be appreciated that combinations of the shaft 34, 36, the compressors 22, 24, and the turbines 28, 30 define a rotor assembly 90 of the engine 10. For example, the HP shaft 34, HP compressor 24, and HP turbine 28 may define a high speed or HP rotor assembly of the engine 10. Similarly, combinations of the LP shaft 36, LP compressor 22, and LP turbine 30 may define a low speed or LP rotor assembly of the engine 10. Various embodiments of the engine 10 may further include the fan shaft 38 and fan blades 42 as the LP rotor assembly. In other embodiments, the engine 10 may further define a fan rotor assembly at least partially mechanically de-coupled from the LP spool via the fan shaft 38 and the reduction gear 40. Still further embodiments may further define one or more intermediate rotor assemblies defined by an intermediate pressure compressor, an intermediate pressure shaft, and an intermediate pressure turbine disposed between the LP rotor assembly and the HP rotor assembly (relative to serial aerodynamic flow arrangement).

During operation of the engine 10, a flow of air, shown schematically by arrows 74, enters an inlet 76 of the engine 10 defined by the fan case or nacelle 44. A portion of air, shown schematically by arrows 80, enters the core engine 16 through a core inlet 20 defined at least partially via the outer casing 18. The flow of air is provided in serial flow through the compressors, the heat addition system, and the expansion section via a core flowpath 70. The flow of air 80 is increasingly compressed as it flows across successive stages of the compressors 22, 24, such as shown schematically by arrows 82. The compressed air 82 enters the heat addition system 26 and mixes with a liquid and/or gaseous fuel and is ignited to produce combustion gases 86. It should be appreciated that the heat addition system 26 may 26 may form any appropriate system for generating combustion gases, including, but not limited to, deflagrative or detonative combustion systems, or combinations thereof. The heat addition system 26 may include annular, can, can-annular, trapped vortex, involute or scroll, rich burn, lean burn, rotating detonation, or pulse detonation configurations, or combinations thereof.

The combustion gases 86 release energy to drive rotation of the HP rotor assembly and the LP rotor assembly before exhausting from the jet exhaust nozzle section 32. The release of energy from the combustion gases 86 further drives rotation of the fan assembly 14, including the fan blades 42. A portion of the air 74 bypasses the core engine 16 and flows across the fan flow passage 48, such as shown schematically by arrows 78.

It should be appreciated that FIG. 1 depicts and describes a two-stream engine having the fan flow passage 48 and the core flowpath 70. The embodiment depicted in FIG. 2 has a nacelle 44 surrounding the fan blades 42, such as to provide noise attenuation, blade-out protection, and other benefits known for nacelles, and which may be referred to herein as a "ducted fan," or the entire engine 10 maybe referred to as a "ducted engine."

In exemplary embodiments, air passing through the fan flow passage 48 may be relatively cooler (e.g. lower temperature) than one or more fluids utilized in the turbomachine. In this way, one or more heat exchangers 200 may be disposed within the fan flow passage 48 (or in alternative locations within the engine 10) and utilized cool one or more fluids from the turbomachine with the air passing through the fan flow passage 48, in order to increase the efficiency of the entire engine 10.

Figure 2:
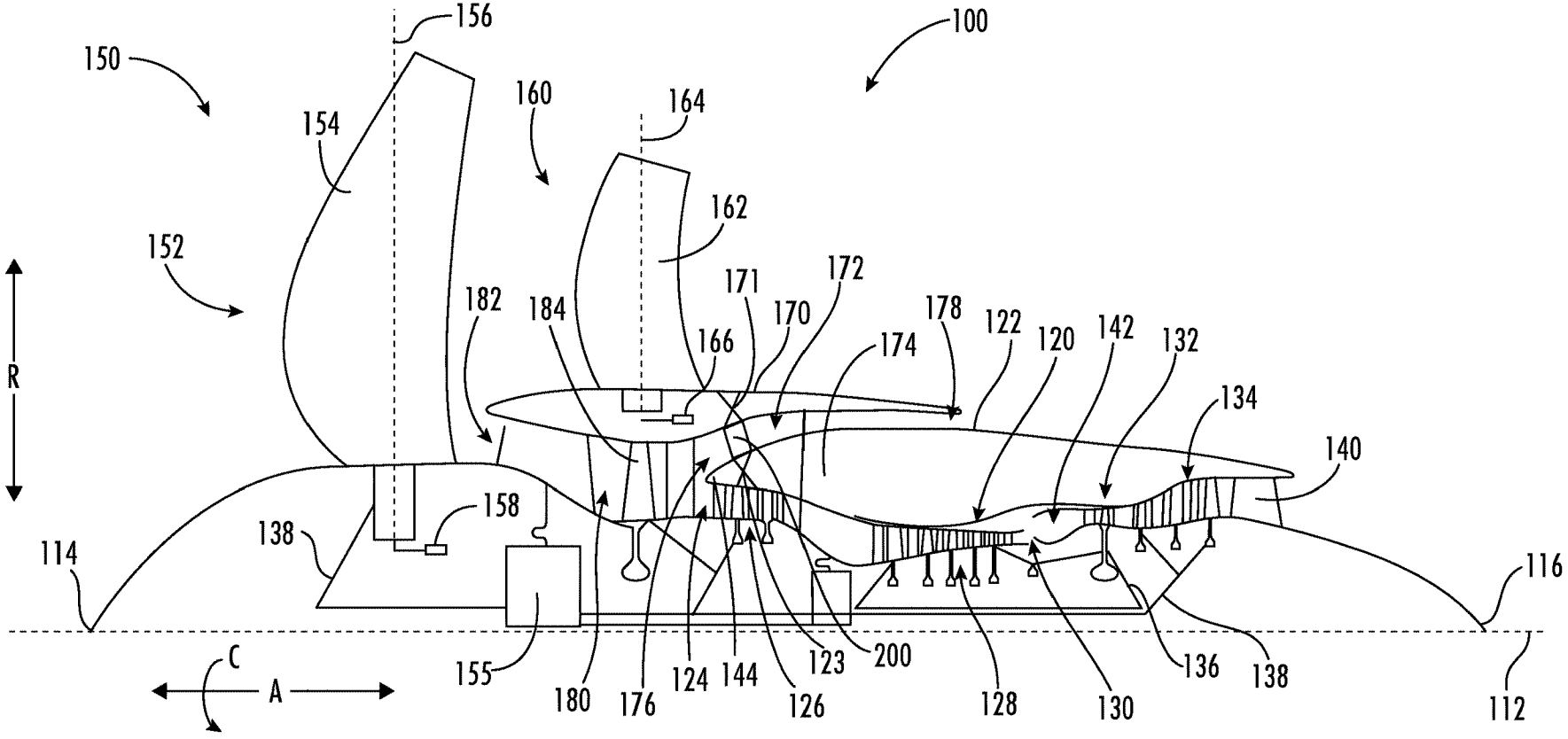
FIG. 2 is a schematic cross-sectional view of a three-stream engine in accordance with an exemplary embodiment of the present disclosure.

FIG. 2 provides a schematic cross-sectional view of a gas turbine engine according to one example embodiment of the present disclosure. Particularly, FIG. 2 provides an aviation three-stream turbofan engine herein referred to as "three-stream engine 100". The three-stream engine 100 of FIG. 2 can be mounted to an aerial vehicle, such as a fixed-wing aircraft, and can produce thrust for propulsion of the aerial vehicle. The three-stream engine 100 is a "three-stream engine" in that its architecture provides three distinct streams of thrust-producing airflow during operation. Unlike the engine 10 shown in FIG. 2, the three-stream engine 100 includes fan that is not ducted by a nacelle or cowl, such that it may be referred to herein as an "unducted fan," or the entire engine 100 may be referred to as an "unducted engine."

Additionally, a "third stream" as used herein means a secondary air stream capable of increasing fluid energy to produce a minority of total propulsion system thrust. A pressure ratio of the third stream is higher than that of the primary propulsion stream (e.g., a bypass or propeller driven propulsion stream). The thrust maybe produced through a dedicated nozzle or through mixing of the secondary air stream with the primary propulsion stream or a core air stream, e.g., into a common nozzle. In certain exemplary embodiments an operating temperature of the secondary air stream is less than a maximum compressor discharge temperature for the engine, and more specifically may be less than 350 degrees Fahrenheit (such as less than 300 degrees Fahrenheit, such as less than 250 degrees Fahrenheit, such as less than 200 degrees Fahrenheit, and at least as great as an ambient temperature). In certain exemplary embodiments these operating temperatures may facilitate heat transfer to or from the secondary air stream and a separate fluid stream. Further, in certain exemplary embodiments, the secondary air stream may contribute less than 50% of the total engine thrust (and at least, e.g., 2% of the total engine thrust) at a takeoff condition, or more particularly while operating at a rated takeoff power at sea level, static flight speed, 86 degrees Fahrenheit ambient temperature operating conditions. Furthermore in certain exemplary embodiments, aspects of the secondary air stream (e.g., airstream, mixing, or exhaust properties), and thereby the aforementioned exemplary percent contribution to total thrust, may passively adjust during engine operation or be modified purposefully through use of engine control features (such as fuel flow, electric machine power, variable stators, variable inlet guide vanes, valves, variable exhaust geometry, or fluidic features) to adjust or optimize overall system performance across a broad range of potential operating conditions. In the embodiments discussed hereinbelow, the fan duct 172 of the three-stream engine 100 may be a "third stream" in accordance with the above definition.

For reference, the three-stream engine 100 defines an axial direction A, a radial direction R, and a circumferential direction C. Moreover, the three-stream engine 100 defines an axial centerline or longitudinal axis 112 that extends along the axial direction A. In general, the axial direction A extends parallel to the longitudinal axis 112, the radial direction R extends outward from and inward to the longitudinal axis 112 in a direction orthogonal to the axial direction A, and the circumferential direction extends three hundred sixty degrees (360°) around the longitudinal axis 112. The three-stream engine 100 extends between a forward end 114 and an aft end 116, e.g., along the axial direction A.

The three-stream engine 100 includes a core engine 120 and a fan section 150 positioned upstream thereof. Generally, the core engine 120 includes, in serial flow order, a compressor section, a combustion section, a turbine section, and an exhaust section. Particularly, as shown in FIG. 2, the core engine 120 includes a core cowl 122 that defines an annular core inlet 124. The core cowl 122 further encloses a low pressure system and a high pressure system. The core cowl 122 may at least partially house a supporting frame 123, which may provide structural support for the core cowl 122 as well as various other components of the three-stream engine 100, such as the one or more heat exchangers 200. For example, the supporting frame 123 may be at least partially housed within the core cowl 122 and may couple to an interior of the core cowl 122, in order to provide structural support for the core cowl 122. In addition, one or more components of the three-stream engine 100 may extend through the core cowl 122 and couple directly to the supporting frame 123, such as the stationary strut 174 and/or the heat exchanger 200. In many embodiments, the core cowl 122 may enclose and support a booster or low pressure ("LP") compressor 126 for pressurizing the air that enters the core engine 120 through core inlet 124. A high pressure ("HP"), multi-stage, axial-flow compressor 128 receives pressurized air from the LP compressor 126 and further increases the pressure of the air. The pressurized air stream flows downstream to a combustor 130 where fuel is injected into the pressurized air stream and ignited to raise the temperature and energy level of the pressurized air. It will be appreciated that as used herein, the terms "high/low speed" and "high/low pressure" are used with respect to the high pressure/high speed system and low pressure/low speed system interchangeably. Further, it will be appreciated that the terms "high" and "low" are used in this same context to distinguish the two systems, and are not meant to imply any absolute speed and/or pressure values.

The high energy combustion products flow from the combustor 130 downstream to a high pressure turbine 132. The high pressure turbine 128 drives the high pressure compressor 128 through a high pressure shaft 136. In this regard, the high pressure turbine 128 is drivingly coupled with the high pressure compressor 128. The high energy combustion products then flow to a low pressure turbine 134. The low pressure turbine 134 drives the low pressure compressor 126 and components of the fan section 150 through a low pressure shaft 138. In this regard, the low pressure turbine 134 is drivingly coupled with the low pressure compressor 126 and components of the fan section 150. The LP shaft 138 is coaxial with the HP shaft 136 in this example embodiment. After driving each of the turbines 132, 134, the combustion products exit the core engine 120 through a core exhaust nozzle 140 to produce propulsive thrust. Accordingly, the core engine 120 defines a core flowpath or core duct 142 that extends between the core inlet 124 and the core exhaust nozzle 140. The core duct 142 is an annular duct positioned generally inward of the core cowl 122 along the radial direction R.

The fan section 150 includes a fan 152, which is the primary fan in this example embodiment. For the depicted embodiment of FIG. 2, the fan 152 is an open rotor or unducted fan. However, in other embodiments, the fan 152 may be ducted, e.g., by a fan casing or nacelle circumferentially surrounding the fan 152. As depicted, the fan 152 includes an array of fan blades 154 (only one shown in FIG. 2). The fan blades 154 are rotatable, e.g., about the longitudinal axis 112. As noted above, the fan 152 is drivingly coupled with the low pressure turbine 134 via the LP shaft 138. The fan 152 can be directly coupled with the LP shaft 138, e.g., in a direct-drive configuration. Optionally, as shown in FIG. 2, the fan 152 can be coupled with the LP shaft 138 via a speed reduction gearbox 155, e.g., in an indirect-drive or geared-drive configuration.

Moreover, the fan blades 154 can be arranged in equal spacing around the longitudinal axis 112. Each blade 154 has a root and a tip and a span defined therebetween. Each blade 154 defines a central blade axis 156. For this embodiment, each blade 154 of the fan 152 is rotatable about their respective central blades axes 156, e.g., in unison with one another. One or more actuators 158 can be controlled to pitch the blades 154 about their respective central blades axes 156. However, in other embodiments, each blade 154 may be fixed or unable to be pitched about its central blade axis 156.

The fan section 150 further includes a fan guide vane array 160 that includes fan guide vanes 162 (only one shown in FIG. 2) disposed around the longitudinal axis 112. For this embodiment, the fan guide vanes 162 are not rotatable about the longitudinal axis 112. Each fan guide vane 162 has a root and a tip and a span defined therebetween. The fan guide vanes 162 may be unshrouded as shown in FIG. 2 or may be shrouded, e.g., by an annular shroud spaced outward from the tips of the fan guide vanes 162 along the radial direction R. Each fan guide vane 162 defines a central blade axis 164. For this embodiment, each fan guide vane 162 of the fan guide vane array 160 is rotatable about their respective central blades axes 164, e.g., in unison with one another. One or more actuators 166 can be controlled to pitch the fan guide vane 162 about their respective central blades axes 164. However, in other embodiments, each fan guide vane 162 may be fixed or unable to be pitched about its central blade axis 164. The fan guide vanes 162 are mounted to a fan cowl 170.

As shown in FIG. 2, in addition to the fan 152, which is unducted, a ducted fan 184 is included aft of the fan 152, such that the three-stream engine 100 includes both a ducted and an unducted fan which both serve to generate thrust through the movement of air without passage through core engine 120. The ducted fan 184 is shown at about the same axial location as the fan guide vane 162, and radially inward of the fan guide vane 162. Alternatively, the ducted fan 184 may be between the fan guide vane 162 and core duct 142, or be farther forward of the fan guide vane 162. The ducted fan 184 may be driven by the low pressure turbine 134 (e.g. coupled to the LP shaft 138), or by any other suitable source of rotation, and may serve as the first stage of booster or may be operated separately.

The fan cowl 170 annularly encases at least a portion of the core cowl 122 and is generally positioned outward of the core cowl 122 along the radial direction R. Particularly, a downstream section of the fan cowl 170 extends over a forward portion of the core cowl 122 to define a third stream or fan duct 172. Incoming air may enter through the fan duct 172 through a fan duct inlet 176 and may exit through a fan exhaust nozzle 178 to produce propulsive thrust. The fan duct 172 is an annular duct positioned generally outward of the core duct 142 along the radial direction R. A supporting frame 171 may be at least partially housed within the fan cowl 122, which may couple to an interior of the fan cowl 170 and provide structural support for the fan cowl 170. In addition, one or more components of the three-stream engine 100 may extend through the fan cowl 170 and couple directly to the supporting frame 171, such as the fan guide vane 162, the struts 174, and/or the heat exchanger 200. The fan cowl 170 and the core cowl 122 are connected together and supported by a plurality of substantially radially-extending, circumferentially-spaced stationary struts 174 (only one shown in FIG. 1). In many embodiments, the stationary struts 174 may be coupled to, and may extend between, the supporting frame 123 housed within the core cowl 122 and the supporting frame 171 housed within the fan cowl 170. The stationary struts 174 may each be aerodynamically contoured to direct air flowing thereby. Other struts in addition to the stationary struts 174 may be used to connect and support the fan cowl 170 and/or core cowl 122. In many embodiments, the fan duct 172 and the core duct 122 may at least partially co-extend (generally axially) on opposite sides (e.g. opposite radial sides) of the core cowl 122. For example, the fan duct 172 and the core duct 122 may each extend directly from the leading edge 144 of the core cowl 122 and may partially co-extend generally axially on opposite radial sides of the core cowl.

The three-stream engine 100 also defines or includes an inlet duct 180. The inlet duct 180 extends between an engine inlet 182 and the core inlet 124/fan duct inlet 176. The engine inlet 182 is defined generally at the forward end of the fan cowl 170 and is positioned between the fan 152 and the array of fan guide vanes 160 along the axial direction A. The inlet duct 180 is an annular duct that is positioned inward of the fan cowl 170 along the radial direction R. Air flowing downstream along the inlet duct 180 is split, not necessarily evenly, into the core duct 142 and the fan duct 172 by a splitter or leading edge 144 of the core cowl 122. The inlet duct 180 is wider than the core duct 142 along the radial direction R. The inlet duct 180 is also wider than the fan duct 172 along the radial direction R.

In exemplary embodiments, air passing through the fan duct 172 may be relatively cooler (e.g. lower temperature) than one or more fluids utilized in the core engine 120. In this way, one or more heat exchangers 200 may be disposed within the fan duct 172 and utilized cool one or more fluids from the core engine with the air passing through the fan duct 172, in order to increase the efficiency of the entire three-stream engine.

Figure 3:
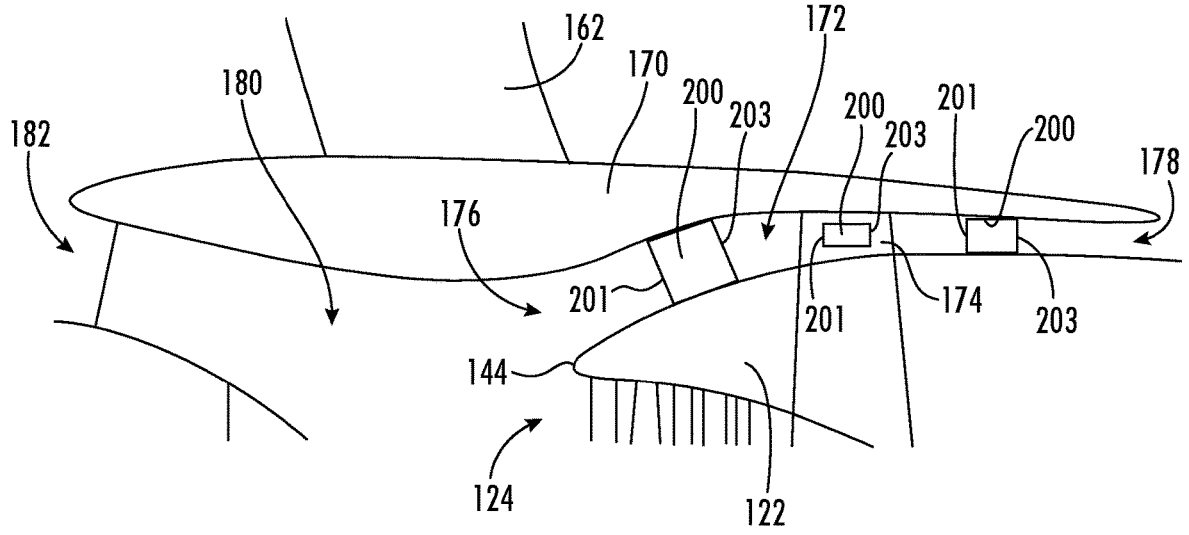
FIG. 3 is a schematic enlarged cross-sectional view of a three-stream engine in accordance with an exemplary embodiment of the present disclosure.
Figure 4:
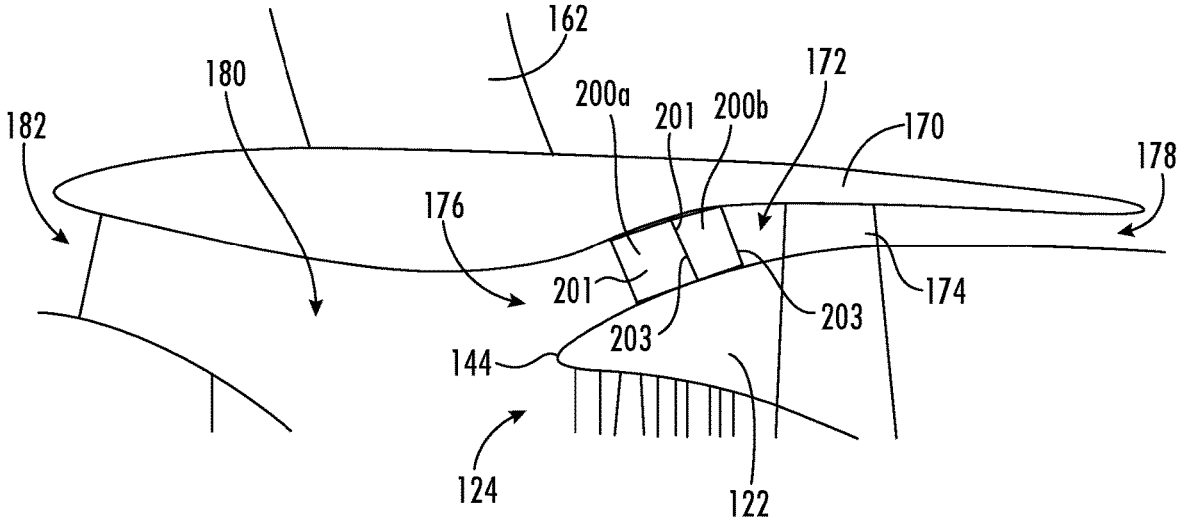
FIG. 4 is a schematic enlarged cross-sectional view of a three-stream engine in accordance with an exemplary embodiment of the present disclosure.

FIGS. 3 and 4 illustrate an enlarged cross-sectional view of a three-stream engine 100 (such as the three-stream engine 100 shown in FIG. 2), which each include one or more heat exchangers 200 disposed within the fan duct 172. As shown, particularly in FIG. 2, in some embodiments, the heat exchanger 200 may be disposed axially forward of the at least one stationary strut 174 within the fan duct 172, such that air passing through the fan duct 172 passes through the heat exchanger 200 prior to passing around the stationary strut 174. Additionally or alternatively, the heat exchanger 200 may be disposed axially aft of the at least one stationary strut 174 within the fan duct 172, such that air passing through the fan duct 172 passes around the stationary strut 174 prior to passing through the heat exchanger 200. In further additional or alternative embodiments, as shown in FIG. 2, one or more heat exchangers 200 may be disposed at the same axial location as the stationary strut 174 (or at least partially axially overlapping with the strut). In such embodiments, as discussed below, the one or more heat exchangers may be at least partially coupled to the stationary strut 174.

Each of the heat exchangers 200 may include an air inlet 201 and an air outlet 203. The air inlet 201 receives air passing through the fan duct 172, which is then routed through the heat exchanger 200 where heat is collected from a motive fluid passing through the heat exchanger 200. The air outlet 203 then expels the used air back into the fan duct 172.

In the embodiment shown in FIG. 3, the heat exchangers 200 may be axially spaced apart from one another, such that air exiting the air outlet 203 of a first heat exchanger 200 travels an axial distance within the fan duct 172 before entering the air inlet 201 of a second heat exchanger. Additionally or alternatively, as shown in FIG. 4, the one or more heat exchangers 200 may be a first heat exchanger 200*a* and a second heat exchanger 200*b* each disposed within the fan duct 172 and axially stacked with one another. In other words, the air outlet 203 of the first heat exchanger 200*a* may be directly adjacent (or coupled to) the air inlet 201 of the second heat exchanger 200*b*, such that all the air exiting the first heat exchanger 200*a* enters the second heat exchanger 200*b*. Such a configuration may be advantageous if, for example, the first heat exchanger 200*a* carries a different motive fluid than the second heat exchanger 200*b*, such that the heat transfer between the air and the respective fluids may be optimized.

Figure 5:
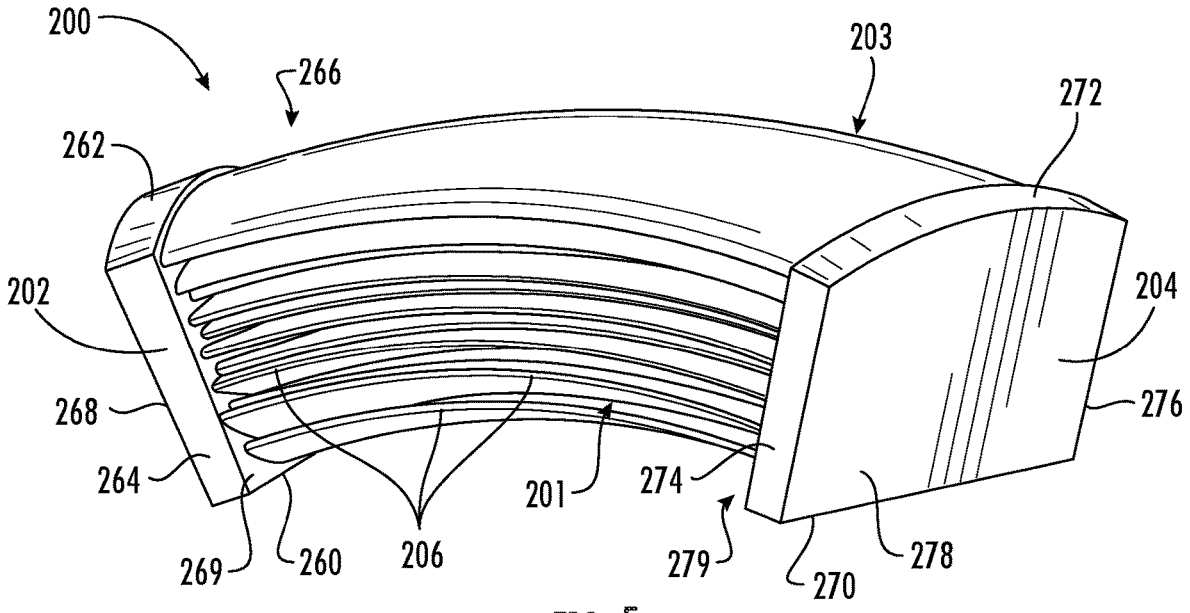
FIG. 5 is an enlarged perspective view of a heat exchanger, which may be employed within a three-stream engine, in accordance with an exemplary embodiment of the present disclosure.

FIG. 5 illustrates an enlarged perspective view of a heat exchanger 200, which may be referred to as an "onion" heat exchanger, and which may be employed in an aircraft engine, such as the engine 10 shown in FIG. 1 (particularly within the fan flow passage 48) or the three-stream engine 100 shown in FIG. 2 (particularly within the fan duct 172), in accordance with embodiments of the present disclosure. As shown, the heat exchanger 200 may include a first wall manifold 202, a second manifold wall 204 spaced apart from the first wall 202, and one or more vanes 206 extending between the first manifold wall 202 and the second manifold wall 204. As discussed further below, the heat exchanger 200 described herein may be substantially hollow, such that a plurality of individualized fluid circuits are defined within the heat exchanger. The plurality of individualized fluid circuits allow for multiple different motive fluids (e.g. from various systems of an aircraft engine) to pass through the heat exchanger 200 simultaneously and thermally communicate with one another and with the air passing through an aircraft engine. For example, both the wall manifolds 202, 204 and the vanes 206, may include various fluid passages and channels circumscribed therein, in order to permit a motive fluid to travel therethrough during operation.

As will be discussed in more detail below, the manifold walls 202, 204 may act as fluid routing manifolds, which route the motive fluid to and from the various passages defined within the vanes 206 of the heat exchanger 200. In exemplary implementations, the heat exchanger 200 may be employed within the fan duct 172 of the three-stream engine 100 (as shown in FIG. 1), where the relatively cool air flowing through the fan duct 172 passes through the vanes 206 and between the manifold walls 202, 204 of the heat exchanger 200 and provides cooling to one or more motive fluid traveling therethrough.

As shown in FIG. 5, the first wall manifold 202 may extend between a radially inward surface 260, a radially outward surface 262, an axially forward surface 264, an axially aft surface 266, and side surfaces 268, 269 that are circumferentially spaced apart from one another. As shown, the first wall manifold 202 may be shaped generally as a rectangular prism having a singular curved surface (e.g. the radially outward surface 262). As discussed below, the radially inward surface 260 of the first wall manifold 202 may define a plurality of openings for the receipt and/or delivery of one or more motive fluids. Similarly, the side surface 268 that faces the vanes 206 may define another plurality of openings for routing the one or more motive fluids into passages defined within the vanes 206.

Likewise, the second wall manifold 204 may extend between a radially inward surface 270, a radially outward surface 272, an axially forward surface 274, an axially aft surface 276, and side surfaces 278, 279 that are circumferentially spaced apart from one another. As shown, the second wall manifold 204 may be shaped generally as a rectangular prism having a singular curved surface (e.g. the radially outward surface 272). As discussed below, the radially inward surface 270 of the second wall manifold 204 may define a plurality of openings for the receipt and/or delivery of one or more motive fluids. Similarly, the side surface 268 that faces the vanes 206 may define another plurality of openings for routing the one or more motive fluids into passages defined within the vanes 206. As shown in FIG. 5, each of the vanes 206 may extend between a side surface 268 of the first wall manifold 202 and a side surface 278 of the second wall manifold 204.

Figure 6:
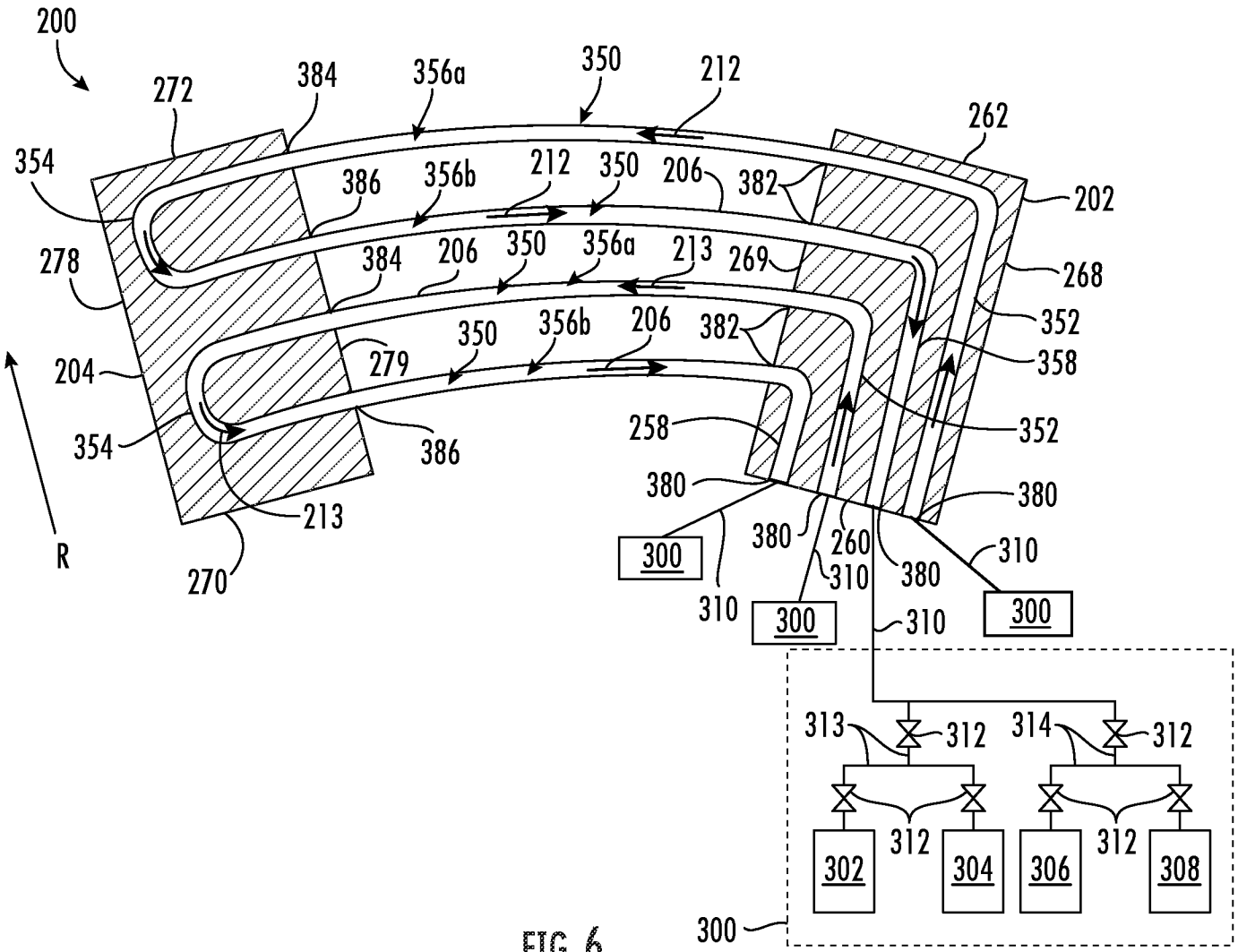
FIG. 6 is a cross-sectional view of a heat exchanger from along an axial direction A, in accordance with embodiments of the present disclosure.

As shown FIG. 5, one or more portions of the heat exchanger 200 (e.g. the radially outer surfaces 262, 272 and the vanes 206), may be generally curved (or non-straight). For example, as shown in FIG. 5, the vanes 206 and/or the radially outer surfaces 262, 272 in contact with the engine 100 may be contoured to correspond with the fan duct 172 and/or the circumferential direction C, in order to utilize the air flow within the heat exchanger 200 without creating a wake within the fan duct 172. In some embodiments, as shown in FIGS. 5 and 6, the first wall manifold 202 and the second wall manifold 204 may generally taper away from one another in the circumferential direction C as they extend radially outward (from the respective radially inward surfaces 260, 270 to the respective radially outward surfaces 262, 272). In this manner, a circumferential length of the vanes 206 may progressively get longer the further radially outward the vanes 206 are positioned on the heat exchanger 200. For example, a circumferential length of the radially inwardmost vane 206 may be shorter than a circumferential length of the radially outwardmost vane 206. This may be advantageous when operating the heat exchanger 200, e.g., if a motive fluid needed more cooling, it could be routed to a fluid circuit disposed within a radially outer vane 206, thereby providing more cooling due to the relative increased length of the vane 206.

In many embodiments, the heat exchanger 200 described herein may be integrally formed as a single component. That is, each of the subcomponents, e.g., the first wall manifold 202, the second wall manifold 204, and the plurality of vanes 206, and any other subcomponent of the heat exchanger 200, may be manufactured together as a single body. In exemplary embodiments, this may be done by utilizing an additive manufacturing system and method, such as direct metal laser sintering (DMLS), direct metal laser melting (DMLM), or other suitable additive manufacturing techniques. In other embodiments, other manufacturing techniques, such as casting or other suitable techniques, may be used. In this regard, by utilizing additive manufacturing methods, the heat exchanger 200 may be integrally formed as a single piece of continuous metal and may thus include fewer sub-components and/or joints compared to prior designs. The integral formation of the heat exchanger 200 through additive manufacturing may advantageously improve the overall assembly process. For example, the integral formation reduces the number of separate parts that must be assembled, thus reducing associated time and overall assembly costs. Additionally, existing issues with, for example, leakage, joint quality between separate parts, and overall performance may advantageously be reduced. Further, the integral formation of the heat exchanger 200 may favorably reduce the weight of the heat exchanger 200 as compared to other manufacturing methods, which thereby decreases the overall weight of the aircraft engine in which it is deployed and increases efficiency.

Alternatively, the first wall manifold 202 and the second wall manifold 204 may each be separately integrally formed. In such embodiments, the first wall manifold 202 and the second wall manifold 204 may each be welded to the plurality of vanes 206. Manufacturing the wall manifolds 202, 204 separately may advantageously reduce production time of the overall heat exchanger 200, thereby cutting manufacturing costs considerably.

FIG. 6 illustrates a cross-sectional view of a heat exchanger 200 from along the axial direction A (when installed within an aircraft engine), in accordance with embodiments of the present disclosure. As shown and discussed partially above, the heat exchanger 200 may include a first wall manifold 202, a second wall manifold 204 spaced apart (e.g. circumferentially spaced apart) from the first wall manifold 202, and a plurality of vanes 206 extending generally circumferentially between the first wall manifold 202 and the second wall manifold 204.

As shown in FIG. 6, the heat exchanger 200 may define a plurality of fluid circuits 350 that extend through the heat exchanger 200 for conveying one or more motive fluids. In this manner, the heat exchanger 200 may be a vessel that provides for thermal communication between one or more motive fluids within an interior of the heat exchanger 200 and the air traveling around the exterior of the heat exchanger 200. For example, each of the fluid circuits 350 may be individually defined within the heat exchanger 200, such that the fluid circuits 350 are fluidly isolated from one another, which advantageously permits the heat exchanger 200 to simultaneously convey multiple different motive fluids through the various fluid circuits 350 (e.g. from multiple different fluid systems of the aircraft engine) at a time without mixing the different fluids together.

As shown in FIG. 6, each fluid circuit 350 in the plurality of fluid circuits 350 includes (in serial flow order) an inlet channel portion 352, a first passage portion 356*a*, a return channel portion 354, and a second passage portion 356*b*, and an outlet channel portion 358. Each fluid circuit 350 may be a singular channel or passage that extends continuously between each of the various portions. For example, each fluid circuit 350 may extend continuously from a respecting inlet channel portion 352, to a respective first passage portion 356*a*, to the return channel portion 354, to a respective second passage portion 356*b*, and finally to the outlet channel portion 358.

The inlet channel portion 352 and the outlet channel portion 358 of each fluid circuit 350 may be defined within the first wall manifold 202, and the return channel portion 354 of each fluid circuit 350 may be defined within the second wall manifold 204. The first passage portion 356*a* and the second passage portion 356*b* may each be one of a plurality of passage portions 356 that are defined within each vane 206 of the plurality of vanes 206. Each return channel portion 354 may fluidly connect a first passage portion 356*a* to a second passage portion 356*b*. As described herein, the inlet channel portion 352 and the outlet channel portion 358 may have a similar construction and may be interchangeable depending on which channel is receiving the motive fluid and which channel is expelling the motive fluid. Thus, it will be appreciated that the terms "inlet" and "outlet" are used in this same context to distinguish the two channel portions and is not necessarily indicative of the direction of the motive fluid. For example, although not shown in FIG. 6, in some embodiments, the outlet channel portion 358 may receive the motive fluid, and the inlet channel portion 352 may expel the motive fluid.

In many embodiments, the inlet channel portion 352 and the outlet channel portion 358 of each fluid circuit 350 may be defined entirely within the first wall manifold 202. Further, both the inlet channel portion 352 and the outlet channel portion 358 may extend between a respective first opening 380 and a respective second opening 382. As shown, each of the respective first openings 280 may be defined in the radially inward surface 260, and each of the respective second openings 282 may be defined in the side surface 269.

Similarly, each return channel portions 354 may be defined entirely within the second wall manifold 204 and may extend between a respective first opening 384 and a respective second opening 386. As shown, both the first openings 384 and the second openings 386 may be defined in the side surface 279, such that the return channel portion 354 routes the motive fluid from the first passage portion 356*a* to the second passage portion 356*b*. For example, the return channel portion 354 may be substantially U-shaped and may function to receive motive fluid from a first passage portion 356*a* of the plurality of passage portions and expel the motive fluid into a second passage portion 356*b* of the plurality of passage portions. In the embodiment shown in FIG. 6, the first passage portion 356*a* and the second passage portion 356*b* may be defined within separate vanes 206 of the heat exchanger 200. In other embodiments, shown in FIG. 8, the first passage portion 356*a* and the second passage portion 356*b* may be defined within the same vane 206. In various embodiments, the first passage portion 356*a* may be defined entirely within one of the vanes 206 and may extend directly between the second opening 382 of the inlet channel portion 352 and the first opening 384 of the return channel portion 354 of the fluid circuit 350. Likewise, the second passage portion 356*b* may be defined entirely within one of the vanes 206 (either a separate vane 206 than the first passage portion 356*a* or the same vane) and may extend directly between the second opening 382 of the outlet channel portion 358 and the second opening 386 of the return channel portion 354 of the fluid circuit 350.

In exemplary embodiments, the heat exchanger 200 may fluidly couple to a fluid system 300. For example, each of the fluid circuits 350 defined within the heat exchanger 200 may separately fluidly couple to the fluid system 300 at both the inlet and the outlet, such that each fluid circuit 350 is operable to pass fluid between the first wall manifold 202 and the second wall manifold 204 in either direction. For example, each respective first openings 280 of the inlet/outlet channel portions 352 and 358 may separately fluidly couple to a respective fluid system 300. Particularly, each of the inlet/outlet channel portions 352 and 358 may independently fluidly couple to a respective fluid system 300 via a connecting conduit 310. In this manner, each fluid circuit 350 defined within the heat exchanger 200 may be independently operable to pass a motive fluid between the first opening 380 of an inlet channel portion 352 and the first opening 380 of an outlet channel portion 358 in either direction.

As shown, the fluid system 300 may include a first motive fluid supply 302, a second motive fluid supply 304, a first motive fluid return 306 that corresponds with the first motive fluid supply 302, and a second motive fluid return 308 that corresponds with the second motive fluid supply 304. Although only two motive fluid supplies and corresponding motive fluid returns are shown in the fluid system 300, it should be appreciated that the fluid system 300 may include any number of motive fluid supplies and corresponding motive fluid returns. In some embodiments, the fluid system 300 may be operable to deliver a different motive fluid (via different motive fluid supplies) to each fluid circuit 350 defined within the heat exchanger 200. The first motive fluid supply 302 may provide a first motive fluid 212 from a system within the engine. For example, the first motive fluid 212 may be a lubricant (or oil) from a lubrication system, a fuel from a fueling system, or other suitable fluid from any system within the aircraft engine that requires cooling. Likewise, the second motive fluid supply 304 may provide a second motive fluid 213 from a system within the engine. For example, the second motive fluid 213 may be a lubricant (or oil) from a lubrication system, a fuel from a fueling system, or other suitable fluid from any system within the aircraft engine that requires cooling.

The first motive fluid supply 302 may be operable to supply a first motive fluid 212 to a fluid circuit 350 (e.g. via either the inlet channel portion 352 or the outlet channel portion 358 depending on which direction the first motive fluid 212 is desired to travel through the heat exchanger 200). The first motive fluid return 306 may be operable to receive the first motive fluid 212 once it has traveled through a fluid circuit 350 of the heat exchanger 200. Similarly, the second motive fluid supply 304 may be operable to deliver a second motive fluid 213 to a fluid circuit 350 (e.g. via either the inlet channel portion 352 or the outlet channel portion 358 depending on which direction the first motive fluid 212 is desired to travel through the heat exchanger 200). The second motive fluid return 308 may be operable to receive the second motive fluid 213 once it has traveled through a fluid circuit 350 of the heat exchanger 200.

The separately defined fluid circuits 350 within the heat exchanger 200, which may be each separately coupled to a respective fluid system 300 at both the inlet and the outlet, advantageously allow for increased operational flexibility. For example, each fluid circuit 350 of the plurality of fluid circuits 350 may be independently operable to receive a motive fluid (e.g. the first motive fluid 212 or the second motive fluid 213), via one of the inlet channel portion 352 or the outlet channel portion 358, from one of the fluid supplies of the fluid system 300 and convey the motive fluid to one of the fluid returns of the fluid system 300, via the other of the inlet channel portion 352 or the outlet channel portion 358. In particular, the system allows for independent operation of each fluid circuit 350 of the plurality of fluid circuits 350 and allows for a motive fluid to be passed between the first wall manifold 202 and the second wall manifold 204 in either or both directions. In addition, the system allows for separate motive fluids (e.g. 212 or 213) to be provided to each fluid circuit 350. For example, in the embodiment shown in FIG. 6, one of the fluid circuits 250 is conveying the second motive fluid 213, and the other of the fluid circuits 250 is conveying the first motive fluid 212.

As shown in FIG. 6, the fluid system 300 may further include valves 312 disposed on both the fluid supply lines 313 and the fluid return lines 314. Each of the valves 312 may be selectively actuated (e.g. by a controller) between an open position and a closed position. For example, one of the valves may be selectively opened to allow for flow of fluid through the respective line or piping to which it is attached. By contrast, when the valves are in a closed position, the flow of fluid through the respective line or piping to which the valve is attached may be restricted or otherwise prevented.

Figure 7:
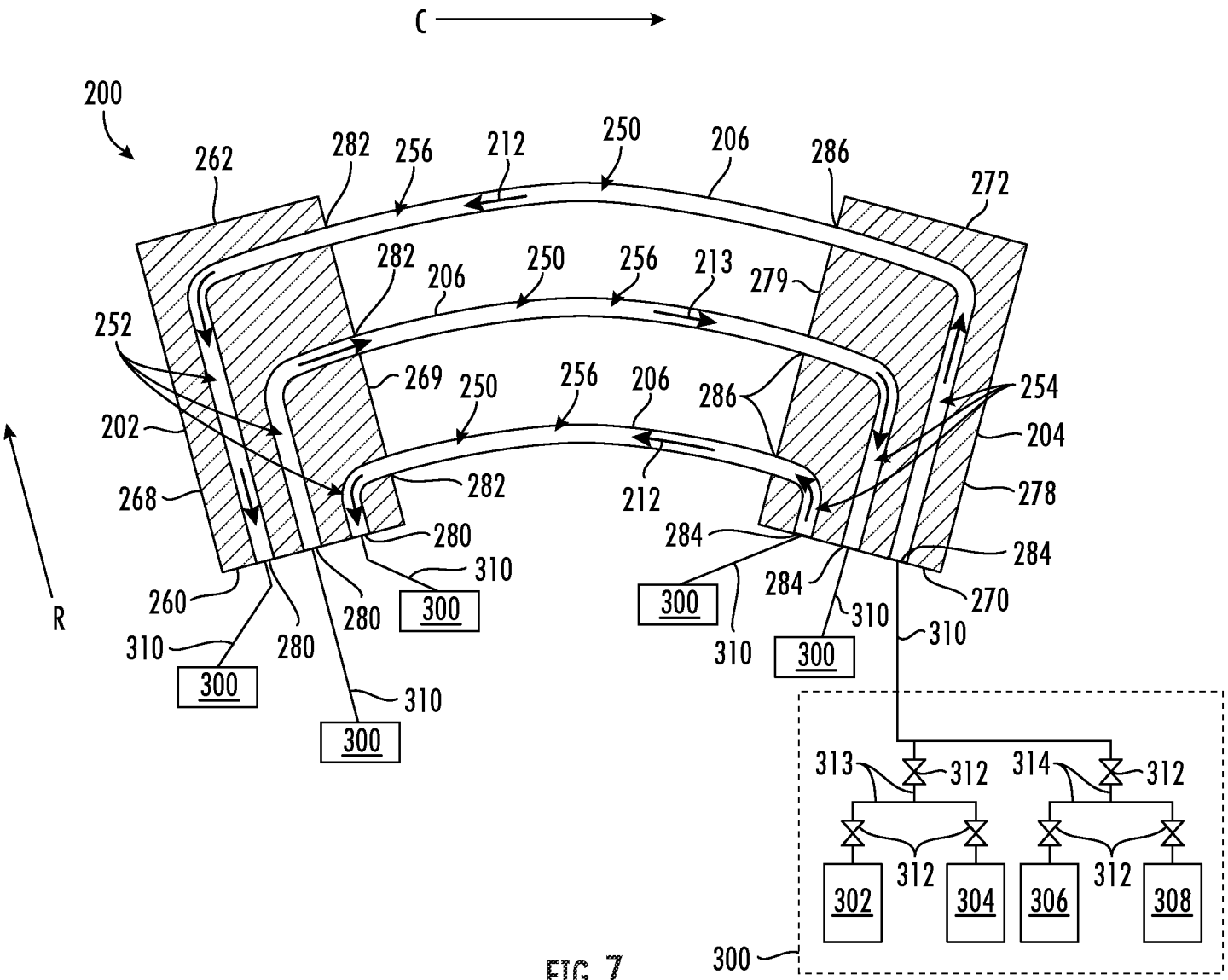
FIG. 7 is a cross-sectional view of a heat exchanger from along an axial direction A, in accordance with embodiments of the present disclosure

FIG. 7 illustrates a cross-sectional view of a heat exchanger 200 from along the axial direction A (when installed within an aircraft engine), in accordance with an alternative embodiment of the present disclosure. As shown and discussed partially above, the heat exchanger 200 may include a first wall manifold 202, a second wall manifold 204 spaced apart (e.g. circumferentially spaced apart) from the first wall manifold 202, and a plurality of vanes 206 extending generally circumferentially between the first wall manifold 202 and the second wall manifold 204.

As shown in FIG. 7, the heat exchanger 200 may define a plurality of fluid circuits 250 that extend through the heat exchanger 200 for conveying one or more motive fluids. In this manner, the heat exchanger 200 may be a vessel that provides for thermal communication between one or more motive fluids within an interior of the heat exchanger and the air traveling around the exterior of the heat exchanger 200. For example, each of the fluid circuits 250 may be individually defined within the heat exchanger 200, such that the fluid circuits 250 are fluidly isolated from one another, which advantageously permits the heat exchanger 200 to simultaneously convey multiple different motive fluids (e.g. from multiple different fluid systems of the aircraft engine) at a time without mixing the different fluids together.

As shown in FIG. 7, each fluid circuit 250 in the plurality of fluid circuits 250 includes a first channel portion 252, a second channel portion 254, and a passage portion 256. The first channel portion 252 may be defined within the first wall manifold 202, and the second channel portion 254 may be defined within the second wall manifold 204. The passage portion 256 may be one of a plurality of passage portions 256 that are each defined within the vane 206. As shown in FIG. 7, the first channel portion 252 may directly fluidly couple to a first end of the passage portion 256, and the second channel portion 254 may directly fluidly couple to a second end of the passage portion 256.

In many embodiments, each first channel portions 252 may be defined entirely within the first wall manifold 202 and may extend between a respective first opening 280 and a respective second opening 282. As shown, each of the respective first openings 280 may be defined in the radially inward surface 260, and each of the respective second openings 282 may be defined in the side surface 269. Similarly, each second channel portions 254 may be defined entirely within the second wall manifold 204 and may extend between a respective first opening 284 and a respective second opening 286. As shown, each of the respective first openings 284 may be defined in the radially inward surface 270, and each of the respective second openings 286 may be defined in the side surface 279. In various embodiments, each passage portion 256 may be defined entirely within the vanes 206 and may extend directly between the second opening 282 of the first portion 252 and the second opening 286 of the second portion 254 of the fluid circuit 250.

In exemplary embodiments, the heat exchanger 200 may fluidly couple to a fluid system 300. For example, each of the fluid circuits 250 defined within the heat exchanger 200 may separately fluidly couple to the fluid system 300 on either end, such that each fluid circuit 250 is operable to pass fluid between the first wall manifold 202 and the second wall manifold 204 in either direction. For example, each respective first opening 280 of the first channel portion 252 may separately fluidly couple to a respective fluid system 300. Likewise, the first opening 284 of the second channel portion 254 may separately fluidly couple to a respective fluid system 300. Particularly, each of the first channel portions 252 may independently fluidly couple to a respective fluid system 300 via a connecting conduit 310. Similarly, each of the second channel portions 252 may independently fluidly couple to a respective fluid system 300 via a connecting conduit 310. In this manner, each fluid circuit 250 defined within the heat exchanger 200 may be independently operable to pass a motive fluid between the first opening 280 of the first channel portion 252 and the first opening 284 of the second channel portion 254 in either direction (e.g. from the opening 280 to the opening 284 or vice versa).

As shown, the fluid system 300 may include a first motive fluid supply 302, a second motive fluid supply 304, a first motive fluid return 306 that corresponds with the first motive fluid supply 302, and a second motive fluid return 308 that corresponds with the second motive fluid supply 304. Although only two motive fluid supplies and corresponding motive fluid returns are shown in the fluid system 300, it should be appreciated that the fluid system 300 may include any number of motive fluid supplies and corresponding motive fluid returns. In some embodiments, the fluid system 300 may be operable to deliver a different motive fluid (via different motive fluid supplies) to each fluid circuit 250 defined within the heat exchanger 200. The first motive fluid supply 302 may provide a first motive fluid 212 from a system within the engine. For example, the first motive fluid 212 may be a lubricant (or oil) from a lubrication system, a fuel from a fueling system, or other suitable fluid from any system within the aircraft engine that requires cooling. Likewise, the second motive fluid supply 304 may provide a second motive fluid 213 from a system within the engine. For example, the second motive fluid 213 may be a lubricant (or oil) from a lubrication system, a fuel from a fueling system, or other suitable fluid from any system within the aircraft engine that requires cooling.

The first motive fluid supply 302 may be operable to supply a first motive fluid 212 to a fluid circuit 250 (e.g. via either the first wall manifold 202 or the second wall manifold 204 depending on which direction the first motive fluid 212 is desired to travel through the heat exchanger 200). The first motive fluid return 306 may be operable to receive the first motive fluid 212 once it has traveled through a fluid circuit 250 of the heat exchanger 200. Similarly, the second motive fluid supply 304 may be operable to deliver a second motive fluid 213 to a fluid circuit 250 (e.g. via either the first wall manifold 202 or the second wall manifold 204 depending on which direction the first motive fluid 213 is desired to travel through the heat exchanger 200). The second motive fluid return 308 may be operable to receive the second motive fluid 213 once it has traveled through a fluid circuit 250 of the heat exchanger 200.

The separately defined fluid circuits 250 within the heat exchanger 200, which may be each separately coupled to a respective fluid system 300 on either end, advantageously allow for increased operational flexibility. For example, each fluid circuit 250 of the plurality of fluid circuits 250 may be independently operable to receive a motive fluid (e.g. the first motive fluid 212 or the second motive fluid 213), via one of the first channel portion 252 or the second channel portion 254, from one of the fluid supplies of the fluid system 300 and convey the motive fluid to one of the fluid returns of the fluid system 300, via the other of the first channel portion 252 or the second channel portion 254. In particular, the system allows for independent operation of each fluid circuit 250 of the plurality of fluid circuits 250 and allows for a motive fluid to be passed between the first wall manifold 202 and the second wall manifold 204 in either direction. In addition, the system allows for separate motive fluids (e.g. 212 or 213) to be provided to each fluid circuit 250. For example, in the embodiment shown in FIG. 7, one of the fluid circuits 250 is conveying the second motive fluid 213 in the circumferential direction C (from the first wall manifold 202 to the second wall manifold 204), and the other two of the fluid circuits 250 are conveying the first motive fluid 212 in a direction opposite the circumferential direction C (from the second wall manifold 204 to the first wall manifold 202).

As shown in FIG. 7, the fluid system 300 may further include valves 312 disposed on both the fluid supply lines 313 and the fluid return lines 314. Each of the valves 312 may be selectively actuated (e.g. by a controller) between an open position and a closed position. For example, one of the valves may be selectively opened to allow for flow of fluid through the respective line or piping to which it is attached. By contrast, when the valves are in a closed position, the flow of fluid through the respective line or piping to which the valve is attached may be restricted or otherwise prevented.

Figure 8:
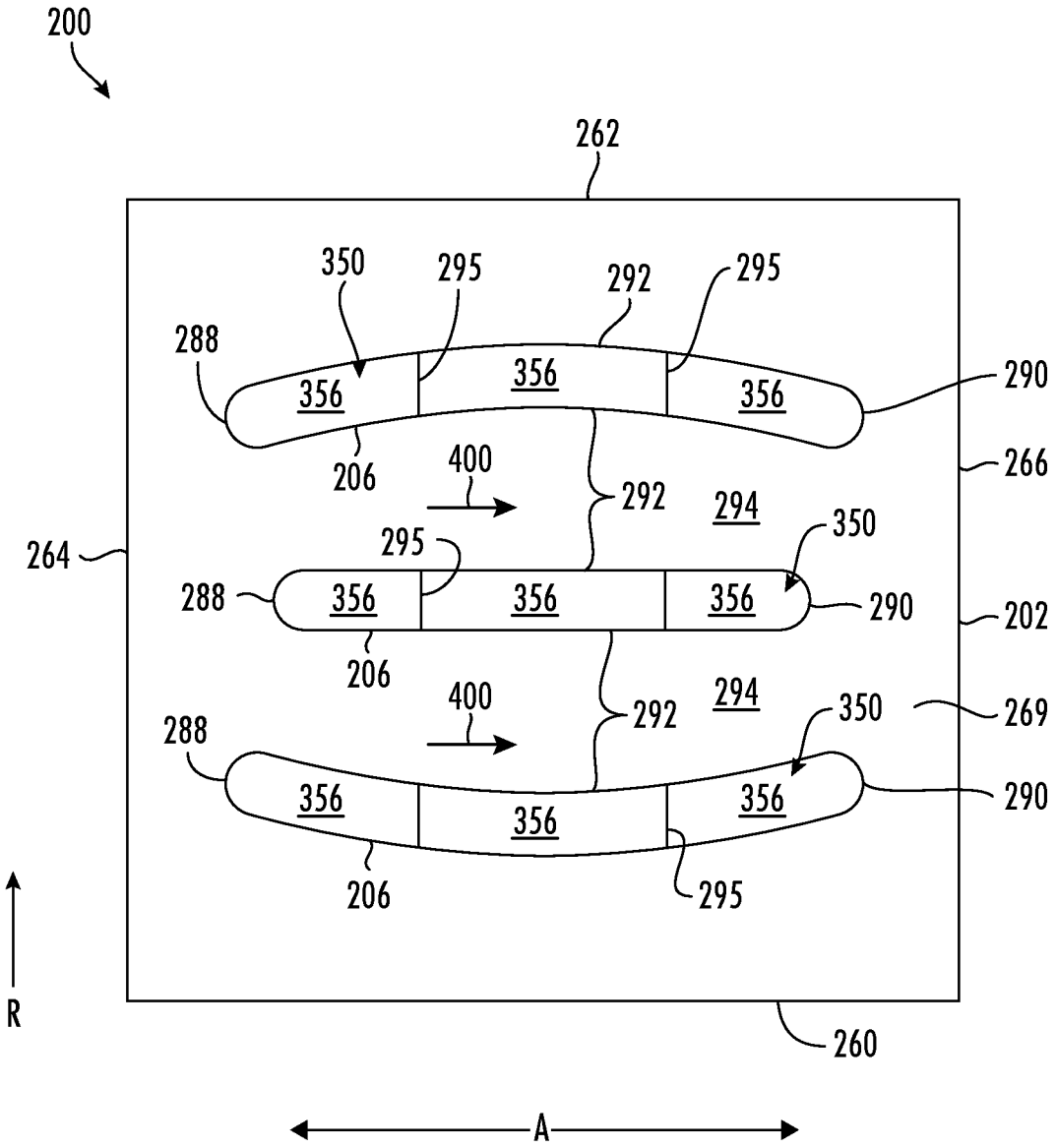
FIG. 8 is a cross sectional view of a heat exchanger from along a circumferential direction C, in accordance with an exemplary embodiment of the present disclosure.

FIG. 8 illustrates a cross sectional view of a heat exchanger 200 from along the circumferential direction C. As shown, each vane 206 may define multiple passage portions 356, which may each correspond to a respective fluid circuit 350 as described above. In exemplary embodiments, each vane 206 in the plurality of vanes 206 may include a leading edge 288, a trailing edge 290, and side walls 292 that extend between the leading edge 288 and the trailing edge 290. As shown in FIG. 8, the plurality of vanes 206 may be spaced apart from one another along the radial direction R to define airflow passages 294 between the vanes 206. In operation, the leading edge 288 may engage air 400 traveling through the engine (e.g. within the fan flow passage 48 or the fan duct 172). The air 400 may then flow into the airflow passage 294 defined between the vanes 206 (e.g. specifically defined radially between the side walls 292 of neighboring vanes 206). Finally, the air 400 may be expelled from the heat exchanger 200 at the trailing edge 290 of the vanes 206. For example, the airflow passages 294 defined between the vanes 206 of the heat exchanger 200 may diverge radially after the leading edge 288 and subsequently converges radially toward the trailing edge 290. In such embodiments, the airflow passages 294 have may have a larger area in the middle, which decreases the Mach number to reduce pressure drop, before gradually converging to pick up velocity to maintain thrust capability. This allows a significant portion of the heat transfer to occur at surfaces in regions of lower Reynolds numbers and friction, which gives the resulting lower pressure drop.

Although the air 400 is fluidly isolated from the motive fluid traveling through each of the passage portions 256 of the fluid circuits 250 defined within the vanes 206 of the heat exchanger 200, the vanes 206 may allow for thermal communication between the air 400 and the motive fluid within the passage portions 256. As shown in FIG. 8, each airflow passage 294 may receive and expel a flow of air 400 in a direction generally perpendicular to the passage portion 256 of each fluid circuit 250 of the plurality of fluid circuits 250.

As shown in FIG. 8, the vanes 206 may further include one or more ribs 295, which may extend generally radially within the vanes 206. The ribs 295 may separate or divide the interior of each vane 206 into the passage portions 356, which may each correspond to a respective fluid circuit 350 as described above.

Figure 9:
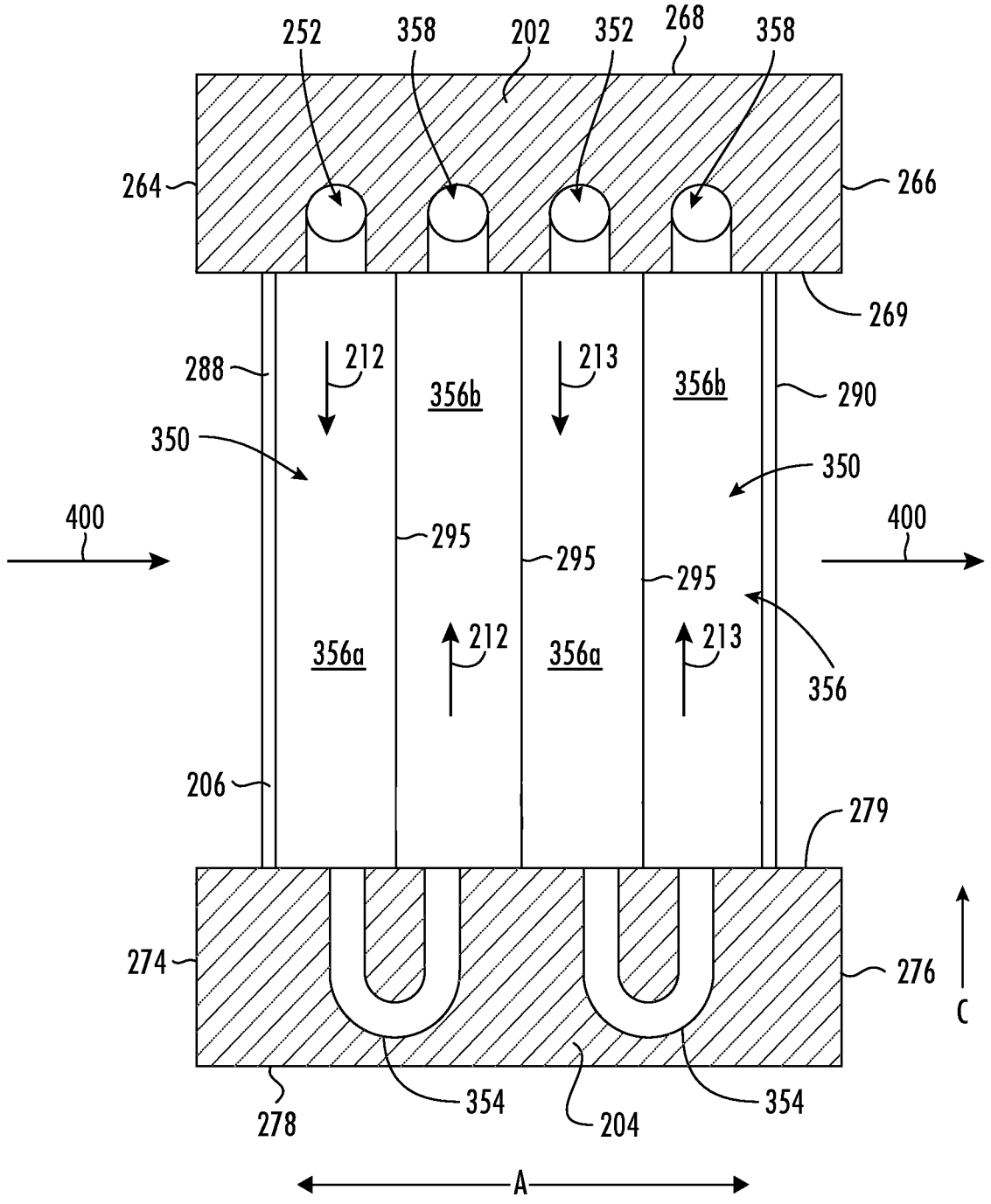
FIG. 9 is a cross-sectional view of a heat exchanger from along a radial direction R, in accordance with an exemplary embodiment of the present disclosure.

FIG. 9 illustrates a cross-sectional view of a heat exchanger 200 from along the radial direction R, in accordance with embodiments of the present disclosure. FIG. 9 illustrates the internal structure of a singular vane 206, within which a plurality of passage portions 356 belonging to fluid circuits 350 may be defined. As opposed to the embodiment shown in FIG. 6, where each of the return channel portions 354 extend from a first passage portion 356*a* defined within a first vane 206 to a second passage portion 356*b* defined within a neighboring vane 206, the return channel portion 354 shown in FIG. 9 fluidly connects and extends between a first passage portion 356*a* and a second passage portion 356*b* each defined within the same vane 206.

Figure 10:
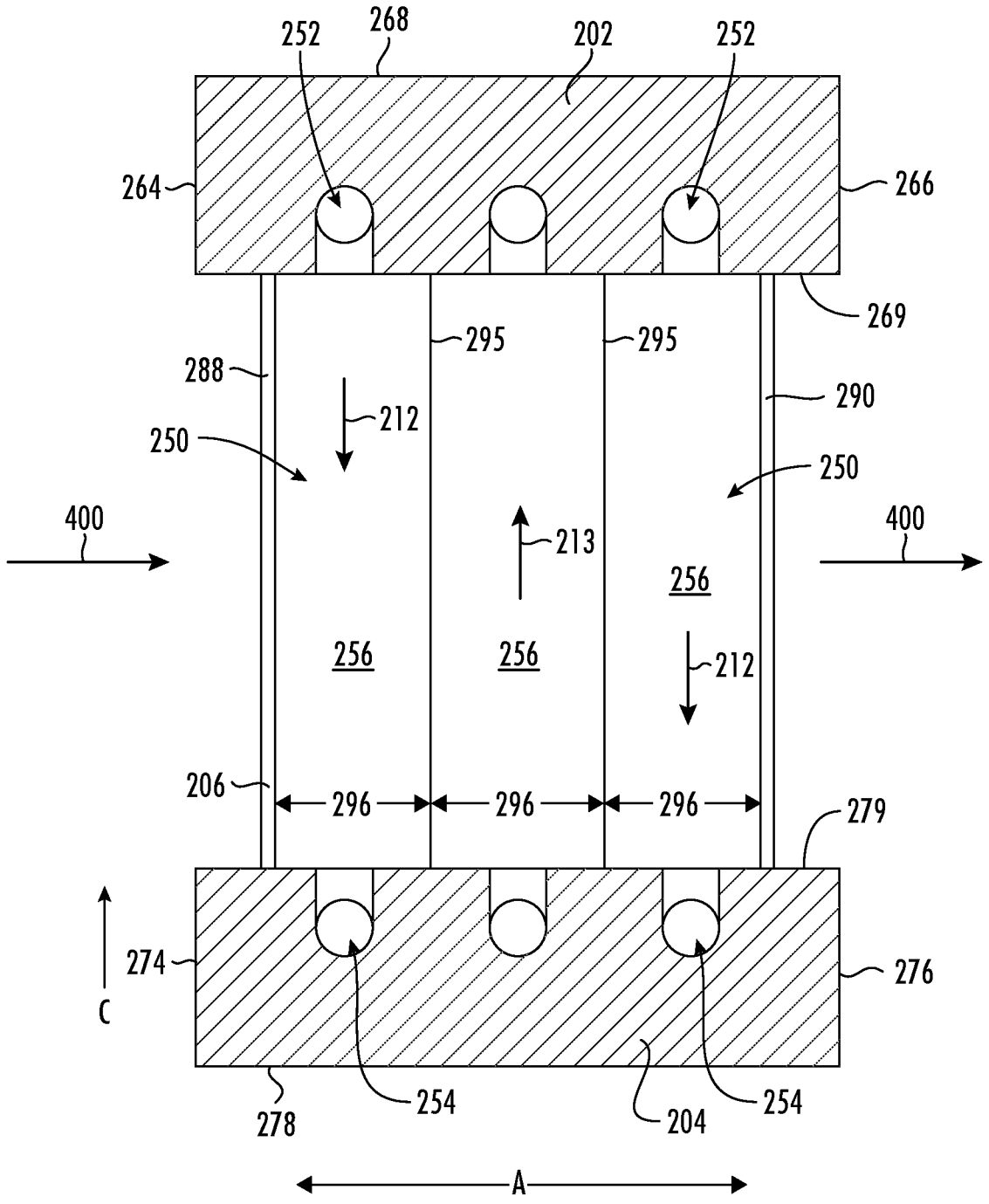
FIG. 10 is a cross-sectional view of a heat exchanger from along a radial direction R, in accordance with an exemplary embodiment of the present disclosure.

FIG. 10 illustrates a cross-sectional view of a heat exchanger 200 from along the radial direction R, which reveals the internal structure of a singular vane 206, in accordance with embodiments of the present disclosure. As shown in FIG. 10, each of the passage portions 256 of the respective fluid circuits 250 may define a width 296. For example, for the axially forwardmost passage portion 256, the width 296 may be defined between a rib 295 and the leading edge 288 of the vane 206. Similarly, for the axially aftmost passage portion 256, the width 296 may be defined between a rib 295 and the trailing edge 290 of the vane 206. For all other passage portions 256, the width 296 may be defined between two axially separated ribs 295. In many embodiments, as shown in FIG. 8, the width 296 of at least one passage portion 256 of the plurality of passage portions 256 may be constant from the first wall manifold 202 to the second wall manifold 204. Specifically, the width 296 of at least one passage portion 256 of the plurality of passage portions 256 may be constant from the side surface 269 of the first wall manifold 202 to the side surface 279 of the second wall manifold 204.

Figure 11:
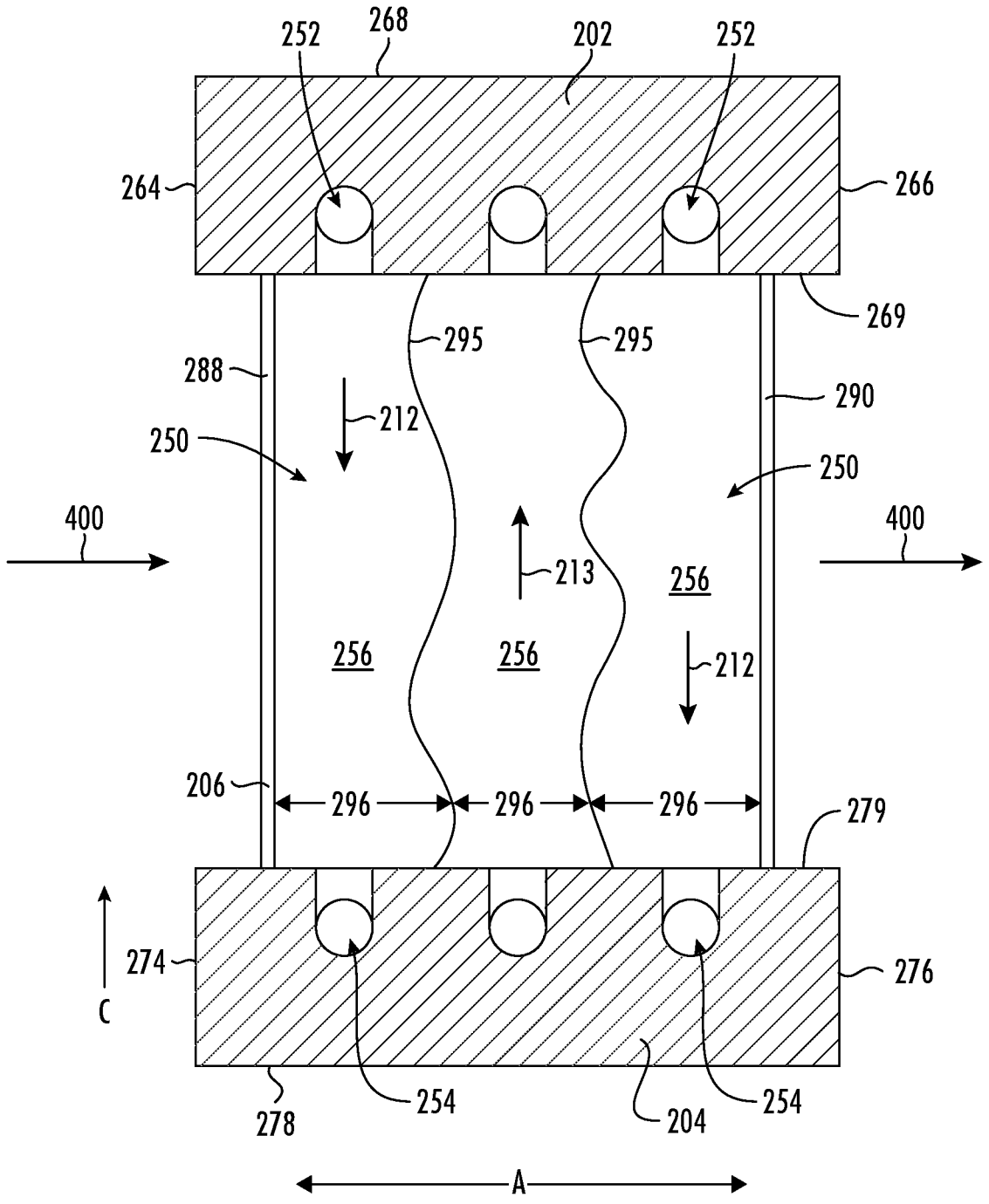
FIG. 11 is a cross-sectional view of a heat exchanger from along a radial direction R, in accordance with an exemplary embodiment of the present disclosure.

Alternatively or additionally, as shown in FIG. 11, the width 296 of at least one passage portion 256 of the plurality of passage portions 256 may continuously varying from the first wall manifold 202 to the second wall manifold 204. Specifically, the width 296 of at least one passage portion 256 of the plurality of passage portions 256 may continuously varying from the side surface 269 of the first wall manifold 202 to the side surface 279 of the second wall manifold 204. In such embodiments, one, multiple, or all of the ribs 295 may converge and diverge axially (in a generally sinusoidal pattern) between the first wall manifold 202 and the second wall manifold 204.

Figure 12:
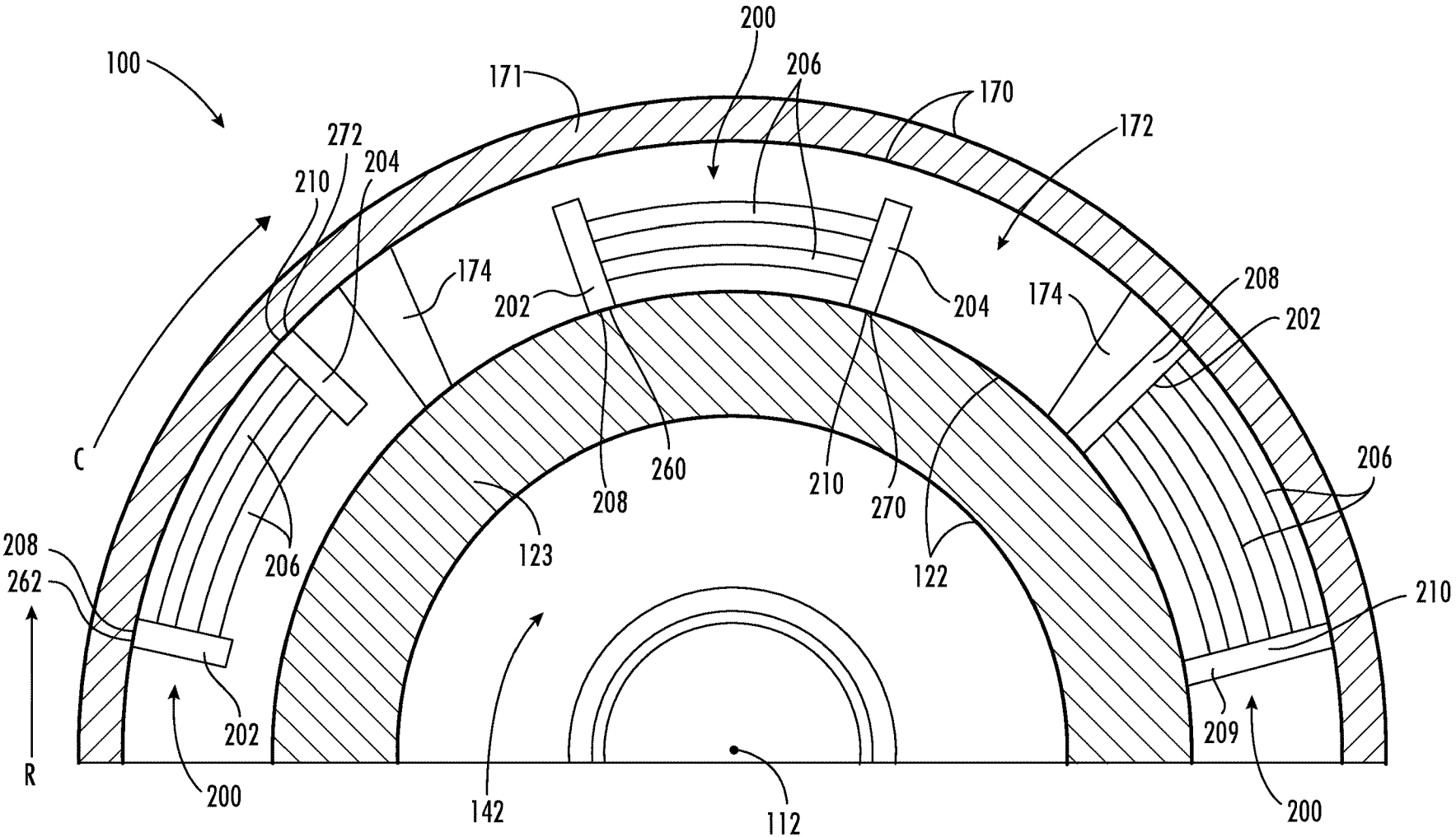
FIG. 12 is a schematic cross-sectional view of a three-stream engine in accordance with an exemplary embodiment of the present disclosure.

FIG. 12 illustrates a schematic cross-sectional view of a three-stream engine 100, in which one or more heat exchangers 200 may be circumferentially arranged within the fan duct 172, in accordance with embodiments of the present disclosure. Although FIG. 12 illustrates half of the three-stream engine 100, it should be understood that the features referenced in 10 maybe employed around the entire engine. Additionally, although a three-stream engine 100 is shown in FIG. 12, it should be understood that the heat exchangers 200 may be employed similarly in another type of aircraft engine (such as the engine 10 shown in FIG. 1). As discussed above, the air flowing through the fan duct 172 may be traveling generally axially (i.e. into and out of the page with respect to FIG. 12). A portion of the air traveling through the fan duct 172 may pass between the heat exchangers 200, and a portion of the air may pass through the heat exchangers 200 (e.g. between the vanes 206 of the heat exchanger 200).

In the embodiment shown in FIG. 12, the heat exchangers 200 may be disposed within the fan duct 172 and circumferentially spaced apart from one another. For example, the heat exchangers 200 may be positioned equidistant (or non-equidistant in some embodiments) from one another in the circumferential direction C within the fan duct 174. In other embodiments (not shown), the heat exchanger(s) 200 may be continuous in the circumferential direction C (e.g.

360° around the longitudinal axis 112), such that all of the air passing through the fan duct 172 flows through the heat exchanger(s) 200. As depicted in FIGS. 12, the core cowl 122 may generally surround and house the supporting frame 123 (shown with cross hatching). Similarly, the fan cowl 170 may generally surround and house the supporting frame 171 (shown with cross hatching). As discussed above, the supporting frames 123, 171 may each provide structural support for the respective cowls 122, 170, as well as various other components of the three stream engine 100. For example, the stationary struts 174 may each extend radially between, and couple to, the supporting frames 123 and 171. Additionally, the one or more heat exchangers 200 may couple (either permanently via a weld or impermanently via a bolt and fastener) to either or both of the supporting frames 123 and 171.

The number, and size, of the heat exchanger(s) 200 may be dependent on how much cooling is needed or required for a specific system. In other words, if a large amount of cooling is needed, then the three-stream engine 100 may employ a heat exchanger(s) 200 that occupies a large portion of the fan duct 172. In such embodiments, where the system requires a large amount of cooling, the circumferential spacing between heat exchangers 200 may be small to none. For example, in some implementations, 100% of the air flowing through the fan duct 172 may pass through the heat exchanger 200. In such implementations, a heat exchanger 200 may extend continuously around the longitudinal centerline 112 (or multiple heat exchangers 200 may abut one another within the fan duct 172 such that no circumferential spacing is provided between heat exchangers 200).

In many implementations, between about 10% and about 100% of the air flowing through the fan duct 172 passes through the heat exchanger 200. In other embodiments, between about 20% and about 100% of the air flowing through the fan duct 172 passes through the heat exchanger 200. In various embodiments, between about 30% and about 100% of the air flowing through the fan duct 172 passes through the heat exchanger 200. In further embodiments, between about 50% and about 100% of the air flowing through the fan duct 172 passes through the heat exchanger 200. In particular embodiments, between about 30% and about 70% of the air flowing through the fan duct 172 passes through the heat exchanger 200.

In various implementations, the heat exchangers 200 may be coupled to the three-stream engine 100 in a variety of ways. For example, as shown, in some embodiments, the heat exchanger 200 may be coupled to the fan cowl 170 (e.g. coupled only to the fan cowl 170 in some embodiments), such that the heat exchanger 200 is secured within the fan duct 172 by the fan cowl 170. In other embodiments, the heat exchanger 200 may be coupled to the core cowl 122 (e.g. coupled only to the core cowl 122 in some embodiments), such that the heat exchanger 200 is secured to within the fan duct 172 by the core cowl 122. In yet still further embodiments, the heart exchanger 200 may be coupled to one or more of the stationary struts 174 (e.g. only to the stationary strut(s) 174 in some embodiments), such that the heat exchanger 200 may be secured within the fan duct by the stationary strut(s) 174. In yet still further embodiments, one or more of heat exchangers may be coupled to any combination of the fan duct 172, the core duct 122, and the one or more stationary struts 174.

In particular embodiments, as described above, each of the heat exchangers 200 may be coupled to a different structure within the fan duct 172 of the three-stream engine 100. For example, as shown, a first heat exchanger 200 may be coupled to the fan cowl 170, a second heat exchanger 200 may be coupled to the core cowl, and a third heat exchanger 200 may be coupled to the stationary strut 174.

Between varying embodiments, the heat exchanger(s) 200 may extend within the fan duct 172 in a variety of ways. For example, in some embodiments, as shown in FIG. 10, one or more heat exchangers 200 may extend radially inward from the fan cowl 170 into the fan duct 172. In such embodiments, the heat exchanger 200 may be radially spaced apart from the core cowl 122, such that the heat exchanger 200 does not contact the core cowl whatsoever in some embodiments. In other embodiments, the heat exchanger 200 may extend radially outward from the core cowl 120 into the fan duct 172. In such embodiments, the heat exchanger 200 may be radially spaced apart from the fan cowl 170, such that the heat exchanger does not contact the fan cowl 170 in some embodiments. In exemplary embodiments, the heat exchanger 200 may extend entirely radially across the fan duct 172 (e.g. between the core cowl 122 and the fan cowl 170).

In exemplary embodiments, the heat exchanger 200 may be mounted within the fan duct 172 only on one end, such that the opposing end of the heat exchanger 200 is free to thermally expand and contract within the fan duct 172, thereby increasing the operational flexibility and life of the heat exchanger 200. For example, as shown, each heat exchanger 200 may extend between a fixed end 208 and a free end 210 within the fan duct 172 to allow for thermal expansion of the heat exchanger 200 within the fan duct 172. For example, the fixed end 208 may be one of the wall manifolds 202, 204, and the free end may be the other of the wall manifolds 202, 204. The fixed end 208 of the heat exchanger may be welded, brazed, or otherwise permanently coupled to one or more of the fan cowl 170, the core cowl 122, and/or the stationary strut 174. The free end 210 of each heat exchanger 200 may not be coupled to the three-stream engine 100, thereby allowing for unrestricted thermal growth of the heat exchanger 200 within the fan duct 172. In some embodiments, the free end 210 may still contact one or more of the fan cowl 170, the core cowl 122, and/or the stationary strut 174, but be entirely decoupled therefrom, such that the free end 210 may be in sliding contact with one or more surfaces defining the fan duct 172 when the heat exchanger 200 is thermally expanding/contracting.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

Further aspects are provided by the subject matter of the following clauses:

A heat exchanger for use in an aircraft engine, the heat exchanger comprising a first wall manifold; a second wall manifold spaced apart from the first wall manifold; a plurality of vanes extending generally circumferentially between the first wall manifold and the second wall manifold; and a plurality of fluid circuits defined within the heat exchanger, each fluid circuit in the plurality of fluid circuits comprising an inlet channel portion and an outlet channel portion defined within the first wall manifold; a return channel portion defined within the second wall manifold; and at least one passage portion of a plurality of passage portions defined within each vane of the plurality of vanes, wherein the at least one passage portion extends between the return channel portion and one of the inlet channel portion and the outlet channel portion.

The heat exchanger of one or more of these clauses, wherein the return channel portion fluidly connects a first passage portion of the plurality of passage portions to a second passage portion of the plurality of passage portions, the first passage portion extending between the return channel portion and the inlet channel portion, and the second passage portion extending between the return channel portion and the outlet channel portion.

The heat exchanger of one or more of these clauses, wherein both the inlet channel portion and the outlet channel portion are separately fluidly coupled to a respective fluid system, the respective fluid system including at least one motive fluid supply and at least one motive fluid return.

The heat exchanger of one or more of these clauses, wherein each fluid circuit of the plurality of fluid circuits is independently operable to receive a motive fluid, via one of the inlet channel portion or the outlet channel portion, from the at least one fluid supply and convey the motive fluid to the at least one fluid return, via the other of the inlet channel portion or the outlet channel portion.

The heat exchanger of one or more of these clauses, wherein the heat exchanger is integrally formed.

The heat exchanger of one or more of these clauses, wherein the first manifold and the second manifold are integrally formed and welded to the plurality of vanes.

The heat exchanger of one or more of these clauses, wherein each vane in the plurality of vanes includes a leading edge, a trailing edge, and side walls extending between the leading edge and the trailing edge.

The heat exchanger of one or more of these clauses, wherein the plurality of vanes are spaced apart from one another along a radial direction to define airflow passages, and wherein each airflow passage is configured to receive and expel a flow of air in a direction generally perpendicular to the at least one passage portion of each fluid circuit of the plurality of fluid circuits.

The heat exchanger of one or more of these clauses, wherein the at least one passage portion of the plurality of passage portions defines a constant width from the first wall manifold to the second wall manifold.

The heat exchanger of one or more of these clauses, wherein the at least one passage portion of the plurality of passage portions defines a continuously varying width from the first wall manifold to the second wall manifold.

An engine comprising a fan section; a core engine disposed downstream of the fan section; a core cowl annularly encasing the core engine and at least partially defining a core duct; a fan cowl disposed radially outward from the core cowl and annularly encasing at least a portion of the core cowl; and a heat exchanger disposed within the fan duct, wherein the heat exchanger provides for thermal communication between a coolant fluid flowing through fan duct and at least one motive fluid flowing through the heat exchanger, the heat exchanger comprising a first wall manifold; a second wall manifold spaced apart from the first wall manifold; a plurality of vanes extending generally circumferentially between the first wall manifold and the second wall manifold; and a plurality of fluid circuits defined within the heat exchanger, each fluid circuit in the plurality of fluid circuits comprising an inlet channel portion and an outlet channel portion defined within the first wall manifold; a return channel portion defined within the second wall manifold; and at least one passage portion of a plurality of passage portions defined within each vane of the plurality of vanes, wherein the at least one passage portion extends between the return channel portion and one of the inlet channel portion and the outlet channel portion.

The engine of one or more of these clauses, wherein the return channel portion fluidly connects a first passage portion of the plurality of passage portions to a second passage portion of the plurality of passage portions, the first passage portion extending between the return channel portion and the inlet channel portion, and the second passage portion extending between the return channel portion and the outlet channel portion.

The engine of one or more of these clauses, wherein both the inlet channel portion and the outlet channel portion are separately fluidly coupled to a respective fluid system, the respective fluid system including at least one motive fluid supply and at least one motive fluid return.

The engine of one or more of these clauses, wherein each fluid circuit of the plurality of fluid circuits is independently operable to receive a motive fluid, via one of the inlet channel portion or the outlet channel portion, from the at least one fluid supply and convey the motive fluid to the at least one fluid return, via the other of the inlet channel portion or the outlet channel portion.

The engine of one or more of these clauses, wherein the heat exchanger is integrally formed.

The engine of one or more of these clauses, wherein each vane in the plurality of vanes includes a leading edge, a trailing edge, and side walls extending between the leading edge and the trailing edge.

The engine of one or more of these clauses, wherein the plurality of vanes are spaced apart from one another along a radial direction to define airflow passages, and wherein each airflow passage is configured to receive and expel a flow of air in a direction generally perpendicular to the at least one passage portion of each fluid circuit of the plurality of fluid circuits.

The heat exchanger of one or more of these clauses, wherein the at least one passage portion of the plurality of passage portions defines a constant width from the first wall manifold to the second wall manifold.

The heat exchanger of one or more of these clauses, wherein the at least one passage portion of the plurality of passage portions defines a continuously varying width from the first wall manifold to the second wall manifold.

A heat exchanger for use in an aircraft engine, the heat exchanger comprising a first wall manifold; a second wall manifold spaced apart from the first wall manifold; a plurality of vanes extending generally circumferentially between the first wall manifold and the second wall manifold; and a plurality of fluid circuits defined within the heat exchanger, each fluid circuit in the plurality of fluid circuits including a first channel portion defined within the first wall manifold, a second channel portion defined within the second wall manifold, and a passage portion of a plurality of passage portions defined within each vane of the plurality of vanes, each passage portion of the plurality of passage portions extending between a respective first channel portion and a respective second channel portion.

What is claimed is:

1. A heat exchanger for use in an aircraft engine, the heat exchanger comprising:

a first wall manifold;

a second wall manifold spaced apart from the first wall manifold;

a plurality of vanes extending generally circumferentially between the first wall manifold and the second wall manifold; and a plurality of fluid circuits defined within the heat exchanger, each fluid circuit in the plurality of fluid circuits including a first channel portion defined within the first wall manifold, a second channel portion defined within the second wall manifold, and at least one passage portion of a plurality of passage portions defined within each vane of the plurality of vanes, each passage portion of the plurality of passage portions extending between a respective first channel portion and a respective second channel portion.

2. The heat exchanger of claim 1, wherein both the first channel portion and the second channel portion are separately fluidly coupled to a respective fluid system, the respective fluid system including at least one motive fluid supply and at least one motive fluid return.

3. The heat exchanger of claim 2, wherein each fluid circuit of the plurality of fluid circuits is independently operable to receive a motive fluid, via one of the first channel portion or the second channel portion, from the at least one motive fluid supply and convey the motive fluid to the at least one motive fluid return, via the other of the first channel portion or the second channel portion.

4. The heat exchanger of claim 1, wherein the heat exchanger is integrally formed.

5. The heat exchanger of claim 1, wherein the first wall manifold and the second wall manifold are integrally formed and welded to the plurality of vanes.

6. The heat exchanger of claim 1, wherein each vane in the plurality of vanes includes a leading edge, a trailing edge, and side walls extending between the leading edge and the trailing edge.

7. The heat exchanger of claim 6, wherein the plurality of vanes are spaced apart from one another along a radial direction to define airflow passages, and wherein each airflow passage is configured to receive and expel a flow of air in a direction generally perpendicular to the at least one passage portion of each fluid circuit of the plurality of fluid circuits.

8. The heat exchanger of claim 1, wherein the at least one passage portion of the plurality of passage portions defines a constant width from the first wall manifold to the second wall manifold.

9. The heat exchanger of claim 1, wherein the at least one passage portion of the plurality of passage portions defines a continuously varying width from the first wall manifold to the second wall manifold.

10. An engine comprising:

a fan section;

a core engine disposed downstream of the fan section;

a core cowl annularly encasing the core engine and at least partially defining a core duct;

a fan cowl disposed radially outward from the core cowl and annularly encasing at least a portion of the core cowl, the fan cowl and core cowl defining in part a fan duct; and a heat exchanger disposed within a fan duct, wherein the heat exchanger provides for thermal communication between a coolant fluid flowing through the fan duct and at least one motive fluid flowing through the heat exchanger, the heat exchanger comprising:

a first wall manifold;

a second wall manifold spaced apart from the first wall manifold;

a plurality of vanes extending generally circumferentially between the first wall manifold and the second wall manifold; and a plurality of fluid circuits defined within the heat exchanger, each fluid circuit in the plurality of fluid circuits including a first channel portion defined within the first wall manifold, a second channel portion defined within the second wall manifold, and at least one passage portion of a plurality of passage portions defined within each vane of the plurality of vanes, each passage portion of the plurality of passage portions extending between a respective first channel portion and a respective second channel portion.

11. The engine of claim 10, wherein both the first channel portion and the second channel portion are separately fluidly coupled to a respective fluid system, the respective fluid system including at least one motive fluid supply and at least one motive fluid return.

12. The engine of claim 11, wherein each fluid circuit of the plurality of fluid circuits is independently operable to receive a motive fluid, via one of the first channel portion or the second channel portion, from the at least one motive fluid supply and convey the motive fluid to the at least one motive fluid return, via the other of the first channel portion or the second channel portion.

13. The engine of claim 10, wherein the heat exchanger is integrally formed.

14. The engine of claim 10, wherein the first wall manifold and the second wall manifold are integrally formed and welded to the plurality of vanes.

15. The engine of claim 10, wherein each vane in the plurality of vanes includes a leading edge, a trailing edge, and side walls extending between the leading edge and the trailing edge.

16. The engine of claim 15, wherein the plurality of vanes are spaced apart from one another along a radial direction to define airflow passages, and wherein each airflow passage is configured to receive and expel a flow of air in a direction generally perpendicular to the at least one passage portion of each fluid circuit of the plurality of fluid circuits.

17. The engine of claim 10, wherein the at least one passage portion of the plurality of passage portions defines a constant width from the first wall manifold to the second wall manifold.

18. The engine of claim 10, wherein the at least one passage portion of the plurality of passage portions defines a continuously varying width from the first wall manifold to the second wall manifold.

19. The engine of claim 10, wherein the fan section comprises an unducted fan.

20. The engine of claim 10, further comprising an outer nacelle surrounding a fan of the fan section.

* * * * *